US009300101B2

(12) United States Patent
Hayes et al.

(10) Patent No.: US 9,300,101 B2
(45) Date of Patent: Mar. 29, 2016

(54) ELECTRIC CABLE SWIVEL AND RELATED FABRICATION METHODS

(71) Applicant: Hayward Industries, Inc., Elizabeth, NJ (US)

(72) Inventors: Graham Matthew Hayes, Winston-Salem, NC (US); Omar Enrique Osuna, Clemmons, NC (US); John Reinhard Kruckeberg, Statesville, NC (US); Armando Colimodio, Clemmons, NC (US); Scott Lancaster, Lexington, NC (US)

(73) Assignee: Hayward Industries, Inc., Elizabeth, NJ (US)

( * ) Notice: Subject to any disclaimer, the term of this patent is extended or adjusted under 35 U.S.C. 154(b) by 0 days.

(21) Appl. No.: 14/156,287

(22) Filed: Jan. 15, 2014

(65) Prior Publication Data

US 2015/0200512 A1 Jul. 16, 2015

(51) Int. Cl.
*H01R 39/00* (2006.01)
*H01R 39/64* (2006.01)
(Continued)

(52) U.S. Cl.
CPC ..... *H01R 39/64* (2013.01); *H01R 13/504* (2013.01); *H01R 13/523* (2013.01); *H01R 13/565* (2013.01); *H01R 43/005* (2013.01); *H01R 43/18* (2013.01); *Y10T 29/49199* (2015.01)

(58) Field of Classification Search
CPC ..... H01R 4/60
USPC ..... 439/184, 201, 271, 521, 675, 20, 589, 439/587, 11, 13; 385/56
See application file for complete search history.

(56) References Cited

U.S. PATENT DOCUMENTS 3,078,998 A 2/1963 Blumenfeld
4,550,958 A 11/1985 Smith
(Continued)

FOREIGN PATENT DOCUMENTS

WO WO 98/51888 11/1998
WO WO 00/45080 8/2000
(Continued)

OTHER PUBLICATIONS

International Search Report of the International Searching Authority mailed on Jul. 14, 2014, issued in connection with International Application No. PCT/US2014/025519 (3 pages).
(Continued)

*Primary Examiner* — Abdullah Riyami
*Assistant Examiner* — Nelson R Burgos-Guntin
(74) *Attorney, Agent, or Firm* — McCarter & English, LLP

(57) ABSTRACT

Improved electric cable swivel assemblies and related fabrication methods are provided. More particularly, the present disclosure provides improved electric cable swivel assemblies configured to reduce entanglement of swimming pool cleaner power cables, and related cable swivel fabrication methods. In exemplary embodiments, the present disclosure provides for a electric cable swivel assembly including a swivel body/housing that is configured and dimensioned to mount with respect to a first cable and a second cable. The swivel body/housing is configured to provide a continuous electrical contact between the first and second cables, wherein the first and second cables are generally axially rotatable relative to each other. Methods of overmolding and/or otherwise fabricating the swivel are disclosed herein.

23 Claims, 19 Drawing Sheets

(51) Int. Cl.

| | |
|---|---|
| ***H01R 43/00*** | (2006.01) |
| ***H01R 13/504*** | (2006.01) |
| ***H01R 13/523*** | (2006.01) |
| ***H01R 13/56*** | (2006.01) |
| ***H01R 43/18*** | (2006.01) |

(56) References Cited

U.S. PATENT DOCUMENTS

| | | | | |
|---|---|---|---|---|
| 4,557,535 | A | 12/1985 | Keane | |
| 4,837,886 | A | 6/1989 | Rawlins | |
| 4,894,014 | A | 1/1990 | Palus et al. | |
| 5,293,659 | A | 3/1994 | Rief et al. | |
| 6,292,970 | B1 | 9/2001 | Rief et al. | |
| 6,294,084 | B1 | 9/2001 | Henkin et al. | |
| 6,412,133 | B1 | 7/2002 | Erlich et al. | |
| 6,625,833 | B1 | 9/2003 | Campbell et al. | |
| RE38,479 | E | 3/2004 | Henkin et al. | |
| 7,503,809 | B2 | 3/2009 | Tsai et al. | |
| 7,637,744 | B2 | 12/2009 | Singer | |
| 7,677,268 | B2 | 3/2010 | Griffin et al. | |
| 7,794,254 | B2 * | 9/2010 | Marklove et al. | 439/271 |
| 7,959,454 | B2 * | 6/2011 | Ramasubramanian et al. | 439/201 |
| 8,042,622 | B2 | 10/2011 | Eriksson et al. | |
| 8,215,962 | B1 | 7/2012 | Machado | |
| 8,847,759 | B2 | 9/2014 | Bisesti et al. | |
| 8,986,017 | B2 | 3/2015 | Borg | |
| 2008/0286986 | A1 | 11/2008 | Rashkover | |
| 2011/0088181 | A1 | 4/2011 | Rief et al. | |
| 2012/0273004 | A1 | 11/2012 | Erlich et al. | |
| 2013/0115784 | A1 | 5/2013 | Gobel et al. | |
| 2014/0273541 | A1 | 9/2014 | Renaud et al. | |

FOREIGN PATENT DOCUMENTS

| | | | |
|---|---|---|---|
| WO | WO 00/73691 | A1 | 12/2000 |
| WO | WO 01/36857 | A2 | 5/2001 |

OTHER PUBLICATIONS

Written Opinion mailed on Jul. 14, 2014, issued in connection with International Application No. PCT/US2014/025519 (4 pages).

Office Action mailed Apr. 10, 2015, issued in connection with U.S. Appl. No. 14/208,247 (5 pages).

* cited by examiner

ELECTRIC CABLE SWIVEL AND RELATED FABRICATION METHODS

BACKGROUND

1. Technical Field

The present disclosure relates to electric cable swivel assemblies and related fabrication methods, and more particularly, to electric cable swivel assemblies configured to reduce entanglement of swimming pool cleaner power/communication cables, and related fabrication methods.

2. Background Art

In general, swimming pool cleaners are known. For example, robotic swimming pool cleaners are generally designed to move along the swimming pool floor and/or walls to clean the surfaces (e.g., from debris, sediment, and the like).

The motion of robotic swimming pool cleaners can be preprogrammed or random motion, or combinations thereof. This may permit a user to activate the swimming pool cleaner and leave it unattended to clean the swimming pool, sometimes without the need for user interaction and/or supervision.

In a swimming pool cleaner of the electrical variety, electrical power is typically provided to the robotic swimming pool cleaner through a power/communication cable extending from the swimming pool cleaner and connecting to a power/communication source in the periphery of the swimming pool. The preprogrammed and/or random motion of swimming pool cleaners with the power cabling associated therewith can create difficulties with respect to power cable entanglement. For example, as the swimming pool cleaner moves along the floor/walls of the swimming pool, the power cables implemented can become twisted/entangled with other power cables, structures around the periphery of the swimming pool, and/or the swimming pool cleaner, thus limiting the motion of the swimming pool cleaner. Moreover, power cable entanglement can create a need for user interaction and/or supervision to ensure that the swimming pool cleaner moves freely along the surface areas of the swimming pool.

Thus, an interest exists for improved electric cable swivel assemblies for reducing entanglement of swimming pool cleaner power cables, and related fabrication methods. These and other inefficiencies and opportunities for improvement are addressed and/or overcome by the assemblies, systems and methods of the present disclosure.

SUMMARY

The present disclosure provides advantageous electric cable swivel assemblies and related fabrication methods. More particularly, the present disclosure provides improved electric cable swivel assemblies configured to reduce entanglement of swimming pool cleaner power cables, and related cable swivel fabrication methods.

In exemplary embodiments, the electric cable swivel assembly includes a swivel body or housing that is configured and dimensioned to mount with respect to a first cable and a second cable. The electric cable swivel assembly is configured to provide a continuous electrical contact between the first and second cables. In general, the electric cable swivel assembly is configured and dimensioned to be assembled together to create a waterproof enclosure for the continuous electrical contact between the first and second cables.

The first and/or second cables are generally axially rotatable relative to each other (e.g., to assist in reducing entanglement of the cables). The first cable can be electrically connected to a power source, and the second cable can be electrically connected to a pool cleaner unit.

In certain embodiments, the electric cable swivel assembly can be attached at an in-line position. In particular, the in-line position typically involves mounting the cable swivel assembly with respect to the first and second cables so that the cable swivel assembly is positioned below the water line.

The present disclosure provides for an electric cable swivel assembly including a housing that extends from a first end to a second end; a seal member configured to mount with respect to the second end of the housing, the seal member extending from a first end to a second end and having an aperture that extends from the first end to the second end; a shaft assembly having an outer member extending from a first end to a second end and having the second end of the outer member mounted with respect to a shaft member and to a first cable assembly associated with a first cable, the shaft member configured to be at least partially housed within the aperture of the seal member and rotatable relative to the seal member and to the housing when the seal member is mounted with respect to the housing; an electrical contact assembly extending from a first end to a second end, the second end of the electrical contact assembly mounted with respect to the first end of the outer member; a support member extending from a first end to a second end and having: (i) the first end of the support member mounted with respect to a second cable assembly associated with a second cable, and (ii) the second end mounted with respect to the first end of the electrical contact assembly; and an overmold member positioned over at least a portion of the housing and the support member, the overmold member configured to hermetically secure the housing and the support member; wherein the electrical contact assembly provides a continuous electrical contact between the first cable and the second cable; and wherein the first cable can rotate axially relative to the second cable.

The present disclosure also provides for an electric cable swivel assembly wherein the first cable extends from a first end to a second end, the first end of the first cable mounted with respect to the outer member and the second end of the first cable mounted with respect to a pool cleaner unit; and wherein the second cable extends from a first end to a second end, the first end of the second cable mounted with respect to the support member and the second end of the second cable mounted with respect to a power source.

The present disclosure also provides for an electric cable swivel assembly wherein the first end of the housing includes at least one rib member that extends from the first end of the housing, the at least one rib member configured to engage the overmold member to facilitate the hermetic securement of the housing. The present disclosure also provides for an electric cable swivel assembly wherein the second end of the housing includes a first shelf surface and a second shelf surface; wherein the seal member includes a first contact surface and a second contact surface; and wherein when the seal member is mounted with respect to the housing, the first shelf surface of the housing engages the first contact surface of the seal member, and the second shelf surface of the housing engages the second contact surface of the seal member.

The present disclosure also provides for an electric cable swivel assembly wherein an outer surface of the seal member includes a first groove that houses a first gasketing material, and a second groove that houses a second gasketing material; and wherein when the seal member is mounted with respect to the housing, the first and second gasketing materials form a fluid-tight seal between the seal member and the housing.

The present disclosure also provides for an electric cable swivel assembly wherein the seal member includes a spring-loaded sealing surface that extends around and proximal to the aperture of the seal member; and wherein when the shaft member is housed within the aperture of the seal member, the spring-loaded sealing surface of the seal member provides a fluid-tight seal between the seal member and the shaft member while allowing the shaft member to rotate relative to the seal member.

The present disclosure also provides for an electric cable swivel assembly wherein the shaft member is substantially tubular; wherein a portion of the first cable is positioned within the shaft member; and wherein the outer member of the shaft assembly is an internal overmold member that is positioned around at least a portion of the shaft member and the first cable to secure the outer member, shaft member and first cable relative to one another. The present disclosure also provides for an electric cable swivel assembly wherein the second end of the outer member includes a protruding section that abuts an abutment surface of the seal member when the shaft member is housed within the aperture of the seal member.

The present disclosure also provides for an electric cable swivel assembly wherein the first and second cable assemblies include at least one electromagnetic interference suppression member. The present disclosure also provides for an electric cable swivel assembly wherein the support member is an internal overmold member that is positioned around at least a portion of the second cable to secure the support member and the second cable relative to one another.

The present disclosure also provides for an electric cable swivel assembly wherein an outer surface of the second end of the support member includes a groove that houses a gasketing material; wherein the second end of the support member includes an abutment surface; wherein when the housing and the support member are hermetically secured, the abutment surface abuts against the first end of the housing, and the gasketing material provides a seal between the support member and the housing.

The present disclosure also provides for a method for fabricating an electric cable swivel assembly for a swimming pool cleaner power cable including providing a housing that extends from a first end to a second end; providing a seal member, the seal member extending from a first end to a second end and having an aperture that extends from the first end to the second end; mounting the seal member with respect to the second end of the housing; providing a shaft assembly having an outer member extending from a first end to a second end; mounting the second end of the outer member with respect to a shaft member and to a first cable assembly associated with a first cable; housing at least a portion of the shaft member within the aperture of the seal member so that the shaft member is rotatable relative to the seal member and to the housing after the seal member is mounted with respect to the housing; providing an electrical contact assembly extending from a first end to a second end; mounting the second end of the electrical contact assembly with respect to the first end of the outer member; providing a support member extending from a first end to a second end; mounting the first end of the support member with respect to a second cable assembly associated with a second cable; mounting the second end of the support member with respect to the first end of the electrical contact assembly; and overmolding an overmold member over at least a portion of the housing and the support member to hermetically secure the housing and the support member; wherein the electrical contact assembly provides a continuous electrical contact between the first cable and the second cable; and wherein the first cable can rotate axially relative to the second cable.

The present disclosure also provides for a method for fabricating an electric cable swivel assembly for a swimming pool cleaner power cable wherein the first cable extends from a first end to a second end, the first end of the first cable mounted with respect to the outer member and the second end of the first cable mounted with respect to a pool cleaner unit; and wherein the second cable extends from a first end to a second end, the first end of the second cable mounted with respect to the support member and the second end of the second cable mounted with respect to a power source.

The present disclosure also provides for a method for fabricating an electric cable swivel assembly for a swimming pool cleaner power cable wherein the first end of the housing includes at least one rib member that extends from the first end of the housing, the at least one rib member configured to engage the overmold member to facilitate the hermetic securement of the housing. The present disclosure also provides for a method for fabricating an electric cable swivel assembly for a swimming pool cleaner power cable wherein the second end of the housing includes a first shelf surface and a second shelf surface; wherein the seal member includes a first contact surface and a second contact surface; and wherein when the seal member is mounted with respect to the housing, the first shelf surface of the housing engages the first contact surface of the seal member, and the second shelf surface of the housing engages the second contact surface of the seal member.

The present disclosure also provides for a method for fabricating an electric cable swivel assembly for a swimming pool cleaner power cable wherein an outer surface of the seal member includes a first groove that houses a first gasketing material, and a second groove that houses a second gasketing material; and wherein when the seal member is mounted with respect to the housing, the first and second gasketing materials form a fluid-tight seal between the seal member and the housing.

The present disclosure also provides for a method for fabricating an electric cable swivel assembly for a swimming pool cleaner power cable wherein the seal member includes a spring-loaded sealing surface that extends around and proximal to the aperture of the seal member; and wherein when the shaft member is housed within the aperture of the seal member, the spring-loaded sealing surface of the seal member provides a fluid-tight seal between the seal member and the shaft member while allowing the shaft member to rotate relative to the seal member.

The present disclosure also provides for a method for fabricating an electric cable swivel assembly for a swimming pool cleaner power cable wherein the shaft member is substantially tubular; wherein a portion of the first cable is positioned within the shaft member; and wherein the outer member is an overmold member that is positioned around at least a portion of the shaft member and the first cable to secure the overmold member, shaft member and first cable relative to one another.

The present disclosure also provides for a method for fabricating an electric cable swivel assembly for a swimming pool cleaner power cable wherein the second end of the outer member includes a protruding section that abuts an abutment surface of the seal member when the shaft member is housed within the aperture of the seal member. The present disclosure also provides for a method for fabricating an electric cable swivel assembly for a swimming pool cleaner power cable wherein the first and second cable assemblies include at least one electromagnetic interference suppression member.

The present disclosure also provides for a method for fabricating an electric cable swivel assembly for a swimming pool cleaner power cable wherein the support member is an internal overmold member that is positioned around at least a portion of the second cable to secure the support member and the second cable relative to one another. The present disclosure also provides for a method for fabricating an electric cable swivel assembly for a swimming pool cleaner power cable wherein an outer surface of the second end of the support member includes a groove that houses a gasketing material; wherein the second end of the support member includes an abutment surface; wherein when the housing and the support member are hermetically secured, the abutment surface abuts against the first end of the housing, and the gasketing material provides a seal between the support member and the housing.

The present disclosure also provides for an electric cable swivel assembly fabricated according to the steps including providing a housing that extends from a first end to a second end; providing a seal member, the seal member extending from a first end to a second end and having an aperture that extends from the first end to the second end; mounting the seal member with respect to the second end of the housing; providing a shaft assembly having an outer member extending from a first end to a second end; mounting the second end of the outer member with respect to a shaft member and to a first cable assembly associated with a first cable; housing at least a portion of the shaft member within the aperture of the seal member so that the shaft member is rotatable relative to the seal member and to the housing after the seal member is mounted with respect to the housing; providing an electrical contact assembly extending from a first end to a second end; mounting the second end of the electrical contact assembly with respect to the first end of the outer member; providing a support member extending from a first end to a second end; mounting the first end of the support member with respect to a second cable assembly associated with a second cable; mounting the second end of the support member with respect to the first end of the electrical contact assembly; and overmolding an overmold member over at least a portion of the housing and the support member to hermetically secure the housing and the support member; wherein the electrical contact assembly provides a continuous electrical contact between the first cable and the second cable; and wherein the first cable can rotate axially relative to the second cable.

Any combination or permutation of embodiments is envisioned. Additional advantageous features, functions and applications of the disclosed assemblies, systems and methods of the present disclosure will be apparent from the description which follows, particularly when read in conjunction with the appended figures. All references listed in this disclosure are hereby incorporated by reference in their entireties.

BRIEF DESCRIPTION OF THE DRAWINGS

Features and aspects of embodiments are described below with reference to the accompanying drawings, in which elements are not necessarily depicted to scale.

Exemplary embodiments of the present disclosure are further described with reference to the appended figures. It is to be noted that the various steps, features/components and combinations of steps/features/components described below and illustrated in the figures can be arranged and organized differently to result in embodiments which are still within the scope of the present disclosure. To assist those of ordinary skill in the art in making and using the disclosed systems, assemblies and methods, reference is made to the appended figures, wherein.

DETAILED DESCRIPTION

Figure 1:
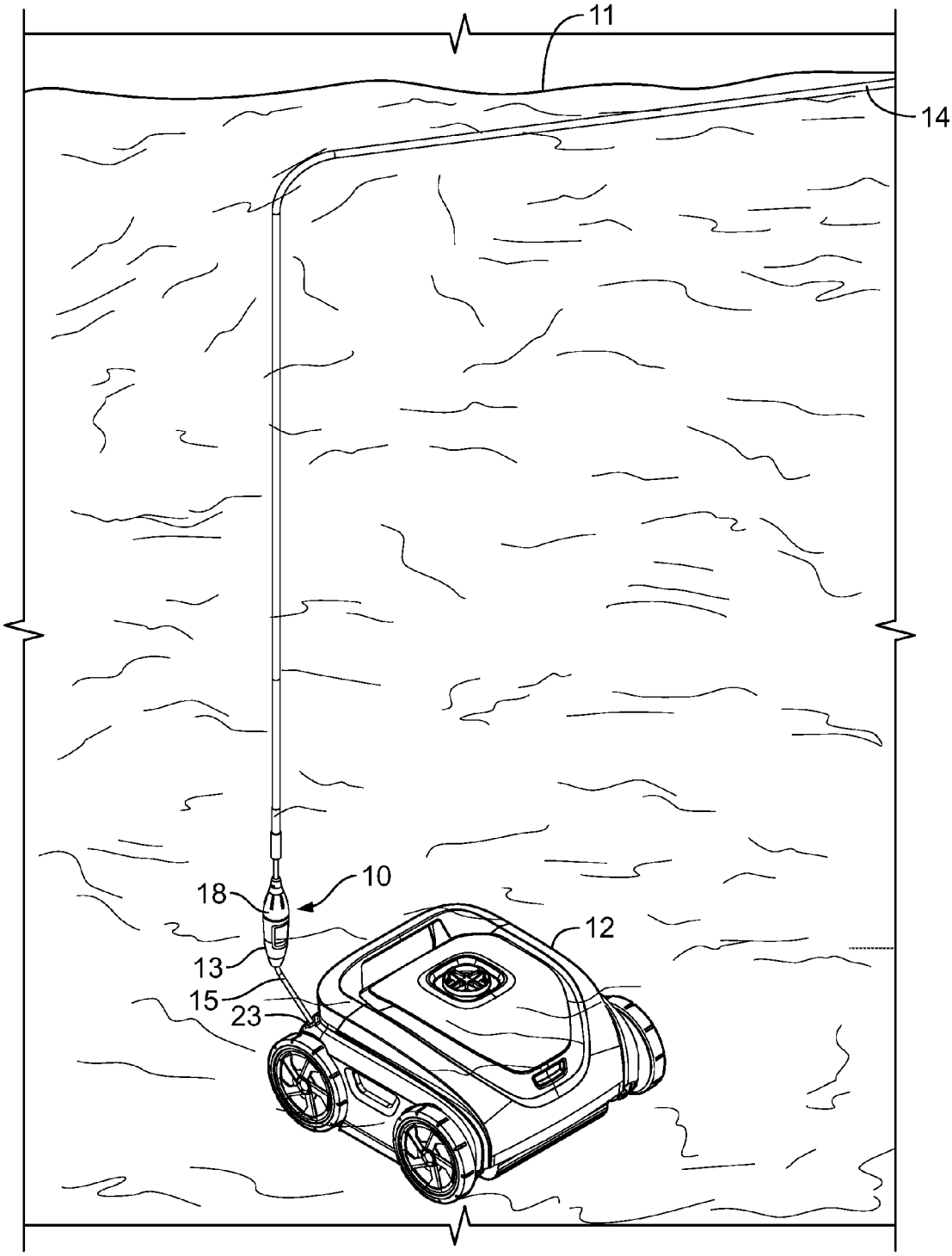
FIG. 1 depicts an exemplary electric cable swivel assembly and cleaner unit according to the present disclosure.
Figure 2:
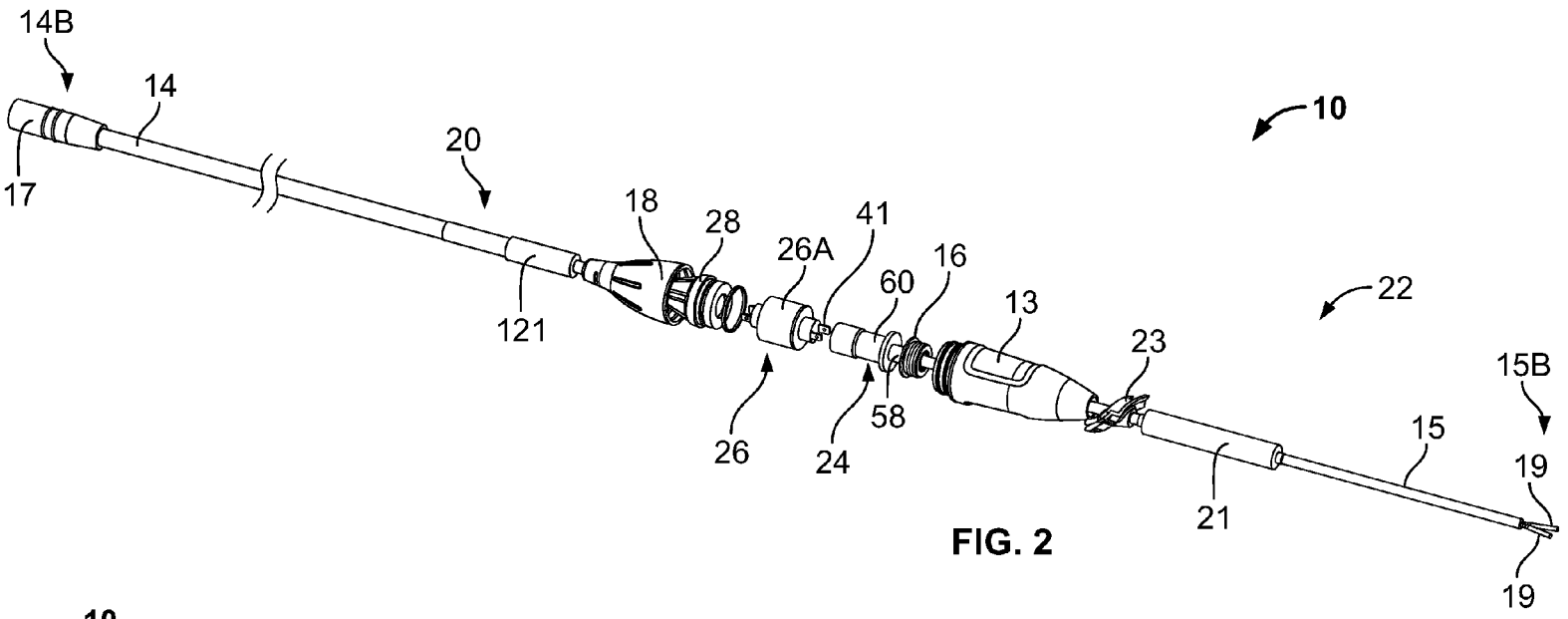
FIG. 2 is an exploded side perspective view of an exemplary electric cable swivel assembly, prior to assembly.

The exemplary embodiments disclosed herein are illustrative of advantageous electric cable swivel assemblies, and systems of the present disclosure and methods/techniques thereof. It should be understood, however, that the disclosed embodiments are merely exemplary of the present disclosure, which may be embodied in various forms. Therefore, details disclosed herein with reference to exemplary electric cable swivel assemblies/fabrication methods and associated processes/techniques of assembly and/or use are not to be interpreted as limiting, but merely as the basis for teaching one skilled in the art how to make and use the advantageous electric cable swivel assemblies of the present disclosure.

The present disclosure provides improved electric cable swivel assemblies and related fabrication methods. In general, the present disclosure provides improved electric cable swivel assemblies configured to reduce entanglement of swimming pool cleaner power cables, and related cable swivel fabrication methods. In exemplary embodiments, the present disclosure provides for a electric cable swivel assembly including a swivel body/housing that is configured and dimensioned to mount with respect to a first cable and a second cable. The electric cable swivel assembly is configured to provide a continuous electrical contact between the first and second cables, wherein the first and/or second cables are generally axially rotatable relative to each other (e.g., to assist in reducing entanglement of the cables). The first cable can be electrically connected to a power source, and the second cable can be electrically connected to a pool cleaner unit. In general, the cable swivel assembly can prevent the cables from tangling, and allows continuous current supply and communication to the pool cleaner from the power source.

Current practice provides that the motion of swimming pool cleaners and their associated power cables can create difficulties with respect to power cable entanglement. For example, as the swimming pool cleaner moves along the pool, the various power cables utilized can become twisted/entangled (e.g., with other power cables and/or structures, and/or with the swimming pool cleaner), thus limiting the motion of the cleaner, thereby creating a need for user interaction/supervision to ensure that the cleaner moves freely. In exemplary embodiments, the present disclosure provides for improved electric cable swivel assemblies for reducing entanglement of swimming pool cleaner power cables, thereby providing a significant operational, commercial and/or manufacturing advantage as a result.

Referring now to the drawings, like parts are marked throughout the specification and drawings with the same reference numerals, respectively. Drawing figures are not necessarily to scale and in certain views, parts may have been exaggerated for purposes of clarity.

With reference to the drawings, and in particular to FIG. 1, there is illustrated an electric cable swivel assembly 10 depicting an embodiment of the present disclosure. In general, cable swivel assembly 10 is configured and dimensioned to reduce entanglement of cables 14, 15 (e.g., swimming pool cleaner power cables 14, 15) or the like.

Electric cable swivel assembly 10 can be mounted with respect to a cleaner unit 12 (e.g., robotic swimming pool cleaner unit 12) for cleaning purposes. For example, cable swivel assembly 10 may be mounted with respect to (e.g., via cables 14, 15) a robotic swimming pool cleaner unit 12 for use in cleaning surfaces of a swimming pool or the like. However, it is noted that exemplary cable swivel assembly 10 is capable of use with other cleaner units or the like for various cleaning purposes (e.g., for use in cleaning surfaces of a spa, tub, tank, fluid system, etc.).

In exemplary embodiments, the electric cable swivel assembly includes a swivel body or housing 13 that is configured and dimensioned to mount with respect to first cable 14 and to second cable 15. In general, cable swivel assembly 10 is configured to provide a continuous electrical contact between the first and second cables 14, 15. Exemplary cable swivel assembly 10 is configured and dimensioned to be assembled together to create a waterproof enclosure for the continuous electrical contact between the first and second cables 14, 15. Stated another way, the cable swivel assembly 10 includes and houses the components that create an electrical connection between the first and second cables 14, 15.

The first and/or second cables 14, 15 are generally axially rotatable relative to each other (e.g., to assist in reducing entanglement of cables 14, 15). The first cable 14 can extend to and be electrically connected to a power source (e.g., a power source/electric outlet in the periphery of the swimming pool), and the second cable 15 can extend to and be electrically connected to pool cleaner unit 12. As such, exemplary cables 14, 15 can extend from cable swivel assembly 10 to the power source and the cleaner unit 12, respectively. In general, cable swivel assembly 10 is configured and dimensioned to prevent the cables 14, 15 from tangling, and allows continuous current supply and communication to the cleaner unit 12 from the power source.

In certain embodiments, the electric cable swivel assembly 10 can be attached at an in-line position. In particular, the in-line position typically involves mounting the cable swivel assembly 10 with respect to the first and second cables 14, 15 so that the cable swivel assembly 10 is positioned below the water line 11, although the present disclosure is not limited thereto. Rather, it is noted that cable swivel assembly 10 can be positioned at a variety of locations/positions (e.g., proximal to water line 11, proximal to cleaner unit 12, above water line 11, proximal to a skimmer, etc.).

As shown in FIGS. 2-9 and as discussed in further detail below, electric cable swivel assembly 10 typically includes swivel body/housing 13, seal member 16, overmold member 18, power cable assembly 20, cleaner cable assembly 22, shaft assembly 24, electrical contact assembly 26 (e.g., slip ring assembly 26) and support member 28.

In exemplary embodiments, electric cable swivel assembly 10 is configured and dimensioned to secure and/or mount with respect to at least a portion of first and second cables 14, 15 so that the first and/or second cables 14, 15 can axially rotate relative to one another. As noted, first cable 14 can extend to and be electrically connected to a power source, and second cable 15 can extend to and be electrically connected to pool cleaner unit 12.

In exemplary embodiments and as discussed further below, at least some of the components of the second cable 15, shaft assembly 24, cleaner cable assembly 22 and/or the electrical contact assembly 26 rotate (e.g., axially rotate) relative to at least some of the other components of cable swivel assembly 10. In general, the rotating components are configured to axially rotate while maintaining an electrical connection between the first and second cables 14, 15. In certain embodiments and as discussed below, a rotational aspect of the cable swivel assembly 10 can be provided by the electrical contact assembly 26.

Figure 3:
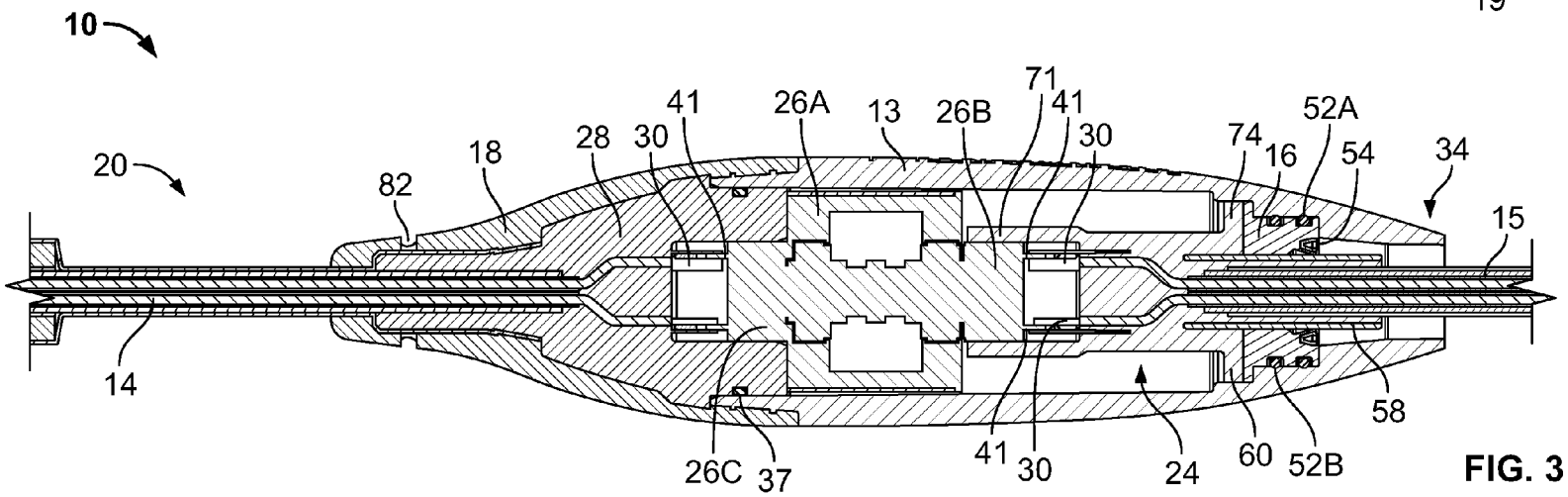
FIG. 3 is a partial cross-sectional view of the cable swivel assembly of FIG. 2, after assembly, and taken along the line 3-3 of FIG. 4.
Figure 4:
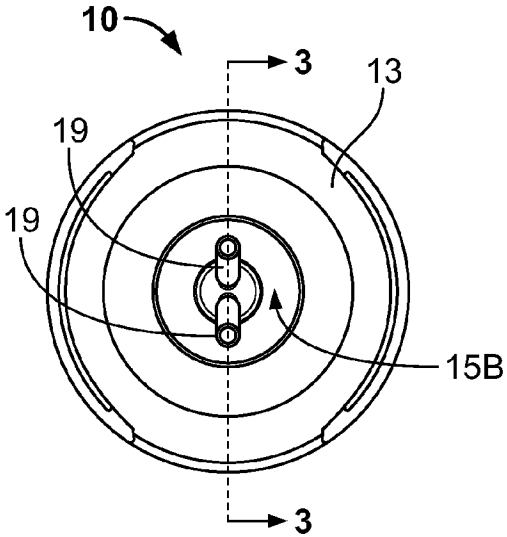
FIG. 4 is an end view of the cable swivel assembly of FIG. 2, after assembly.
Figure 5:
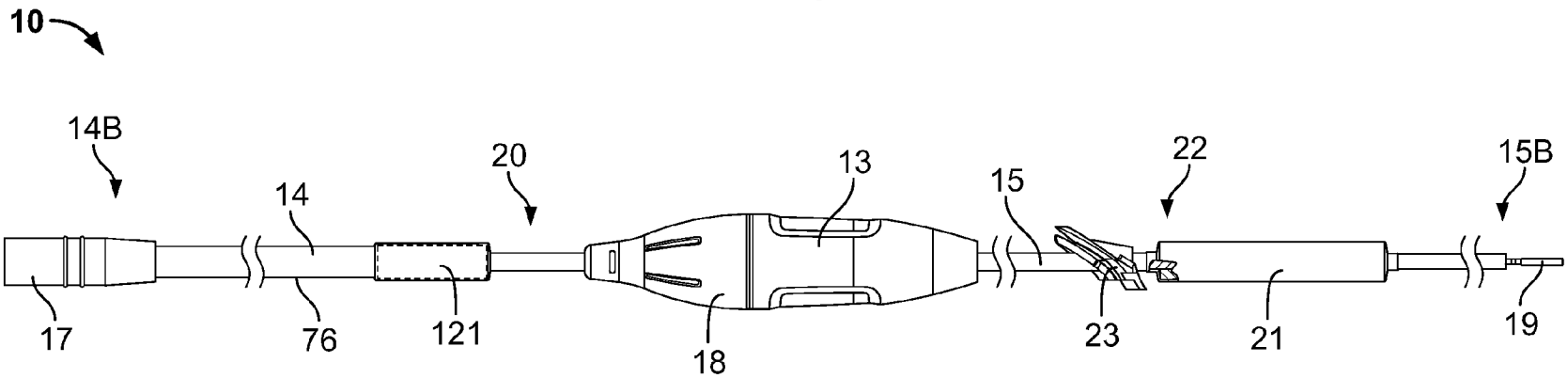
FIG. 5 is a side view of the cable swivel assembly of FIG. 2, after assembly.
Figure 6:
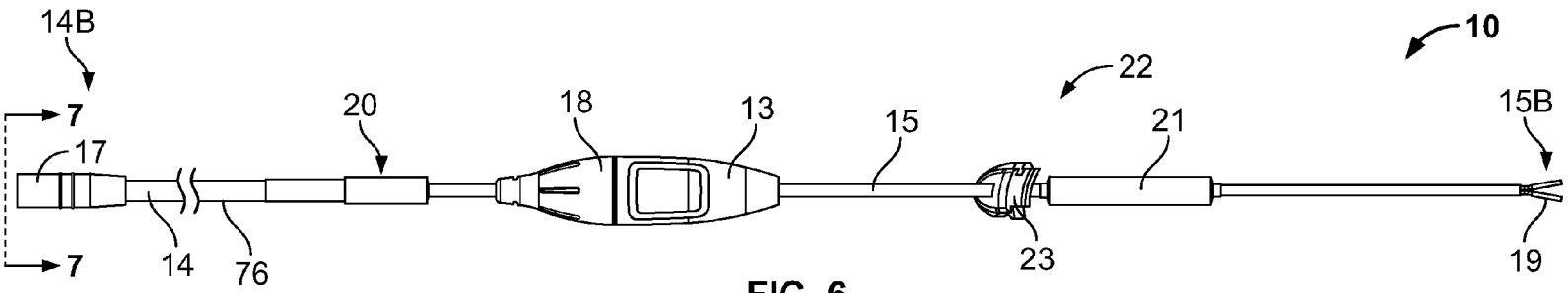
FIG. 6 is another side view of the cable swivel assembly of FIG. 5.
Figure 7:
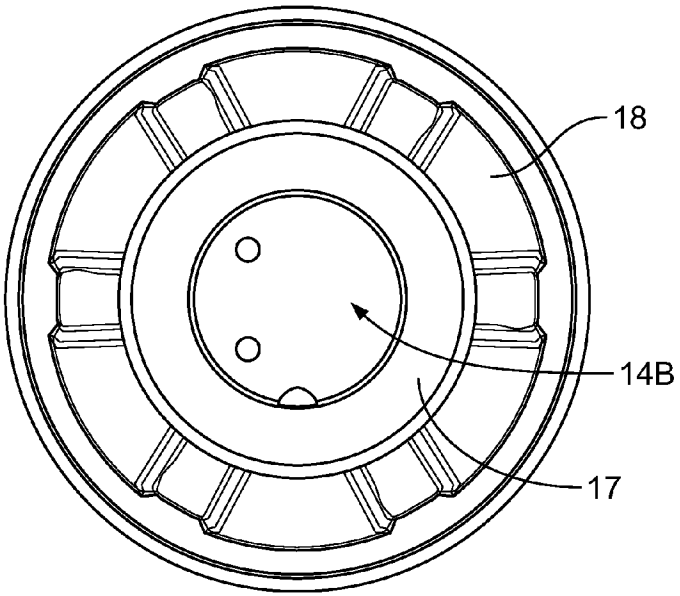
FIG. 7 is an end view of the cable swivel assembly of FIG. 6.
Figure 12:
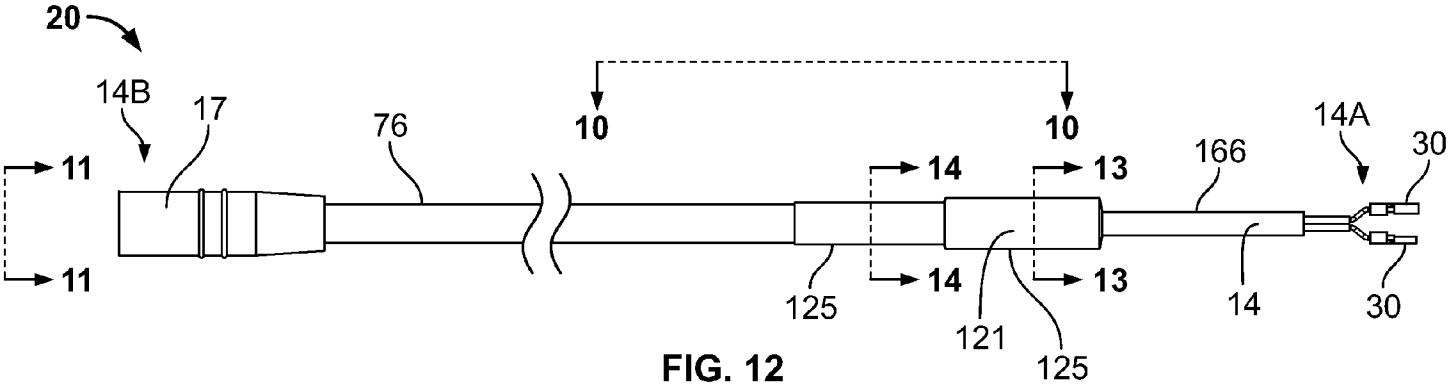
FIG. 12 is another partial side view of the power cable assembly of FIG. 10.
Figure 23:
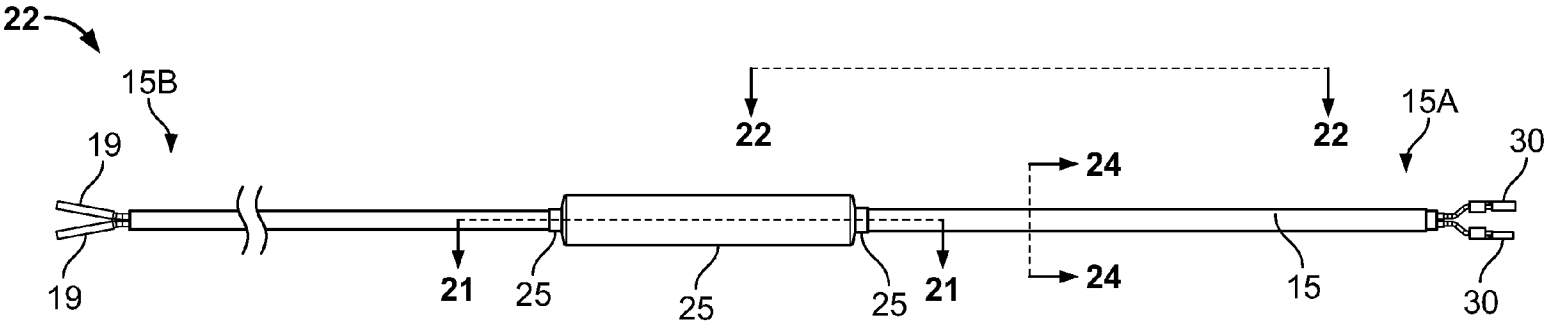
FIG. 23 is another partial side view of the cable assembly of FIG. 22.

Exemplary cables 14, 15 each include one or more terminals/connectors 30 (e.g., female spade connectors 30) extending from their proximal ends 14A, 15A, respectively (FIGS. 3, 12 and 23). Distal end 14B of cable 14 is configured to electrically connect with a power source via plug 17 (e.g., overmolded plug 17), and distal end 15B of cable 15 is configured to electrically connect with cleaner unit 12 (e.g., to the motor box of cleaner unit 12) via connectors 19 (e.g., female pin connectors 19). In general, connectors 30 are configured to mate with connectors/plugs 41 of the electrical contact assembly 26, thereby providing an electrical connection between the first and second cables 14 and 15 (via electrical contact assembly 26). Exemplary electrical contact assembly 26 takes the form of a slip ring assembly 26 or the like (e.g., SRC Pin Connection Slip Ring, SRC 032 Series, Hangzhou Prosper Mechanical & Electrical Technology Co., Ltd., (2011)), although the present disclosure is not limited thereto. Rather, electrical contact assembly 26 can take a variety of forms.

Figure 31:
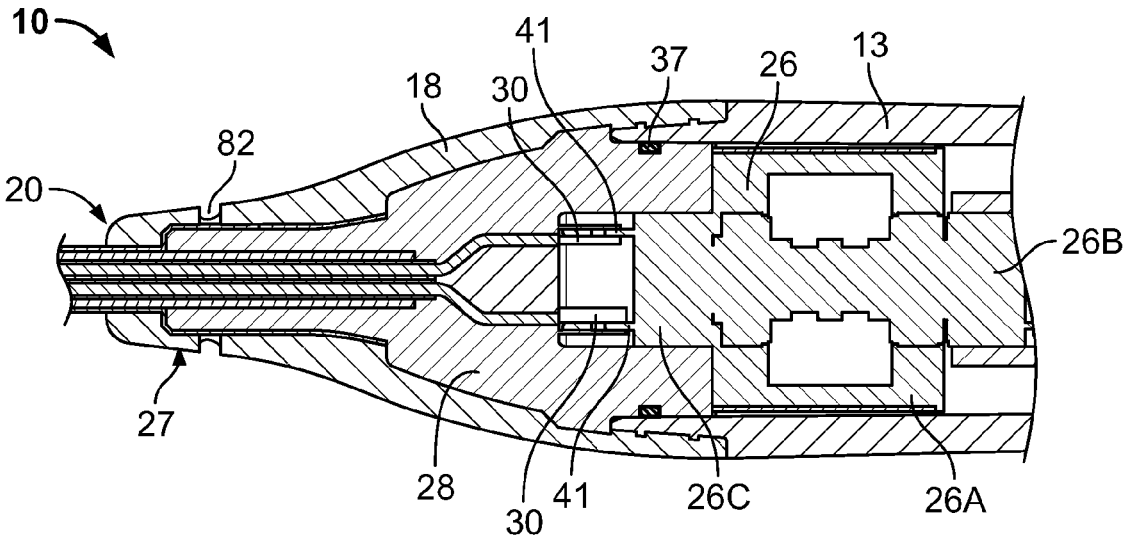
FIG. 31 is a partial cross-sectional view of the cable swivel assembly of FIG. 25, and taken along the line 31-31 of FIG. 25.
Figure 32:
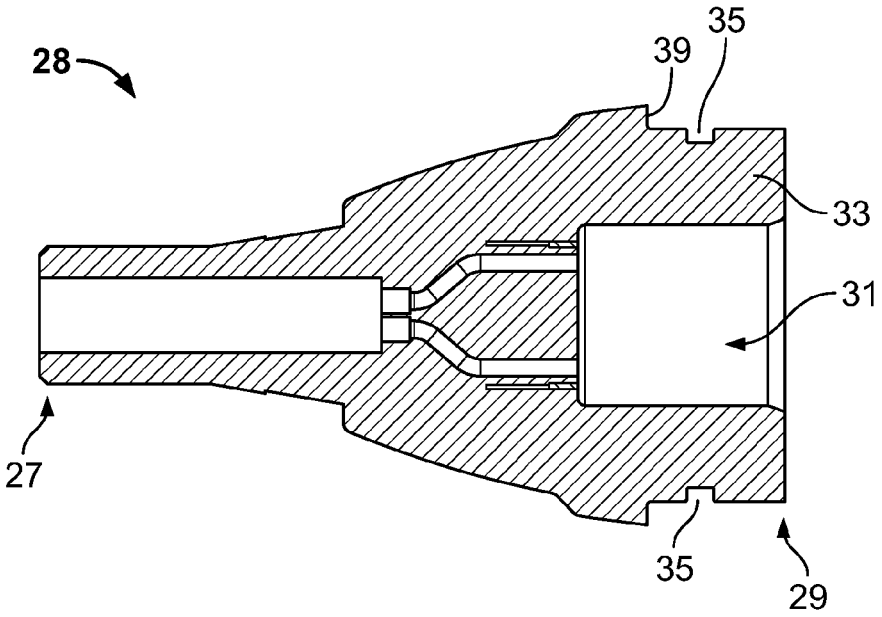
FIG. 32 is a cross-sectional view of an exemplary receiver member for use with the cable swivel assembly of FIG. 2, and taken along the line 32-32 of FIG. 33.
Figure 33:
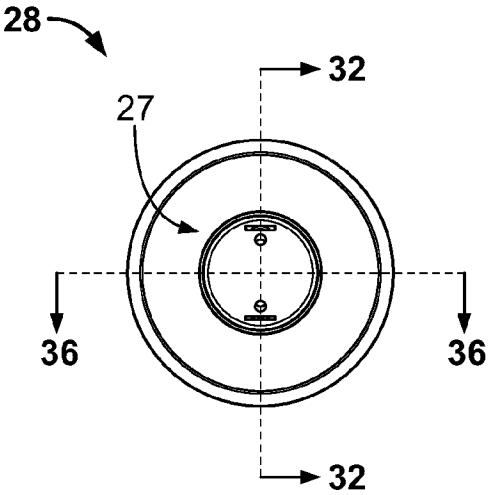
FIG. 33 is an end view of the receiver member of FIG. 32.
Figure 34:
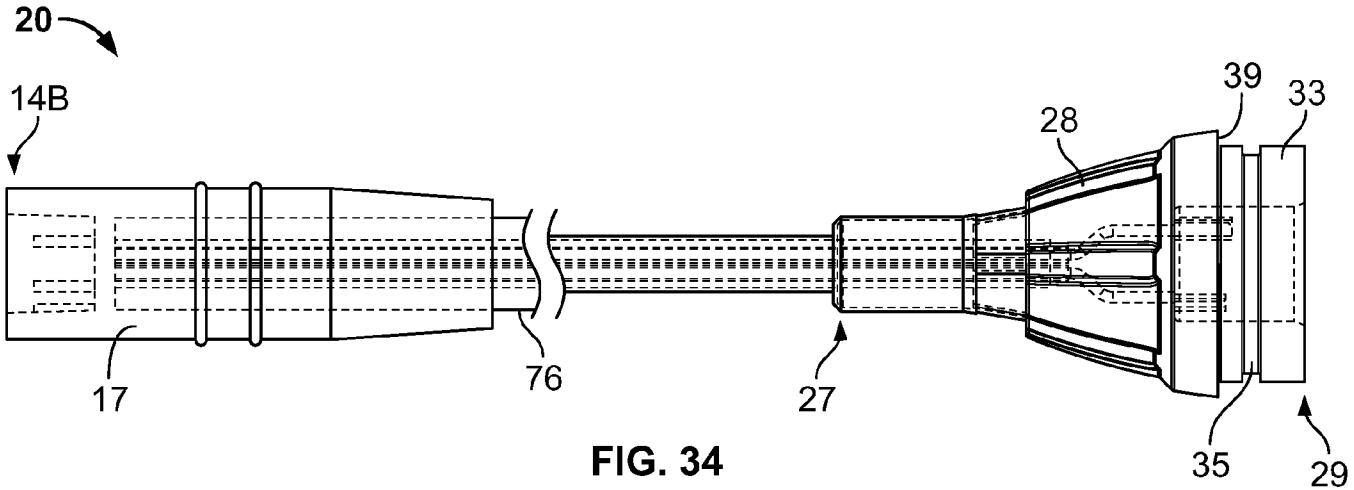
FIG. 34 is a partial side view of the receiver member of FIG. 32 and the power cable assembly of FIG. 10.
Figure 35:
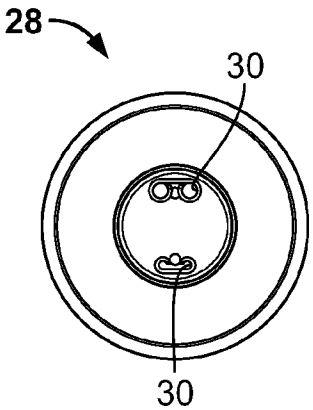
FIG. 35 is another end view of the receiver member of FIG. 32.

In some embodiments, electrical contact assembly 26 is configured to include at least one rotating portion to allow first and/or second cable 14, 15 to rotate relative to one another, while maintaining an electrical connection therebetween. In one embodiment, the electrical contact assembly 26 defines a central body 26A, with a first extension 26B and a second extension 26C extending from each side of the central body 26A (FIGS. 3 and 31). It is noted that at least one of the first and second extensions 26B and/or 26C can rotate relative to central body 26A.

In an exemplary embodiment, first extension 26B rotates relative to central body 26A, and second extension 26C is static relative to central body 26A (e.g., second extension 26C is fixed or stationary relative to central body 26A). For example, at least some of the components of the second cable 15, shaft assembly 24 and cleaner cable assembly 22, along with first extension 26B, can rotate (e.g., axially rotate) relative to at least some of the other components of cable swivel assembly 10 (e.g., the other components of assembly 10 except second cable 15, shaft assembly 24, cleaner cable assembly 22, and first extension 26B). As noted, the rotating components are configured to axially rotate while maintaining an electrical connection between the first and second cables 14, 15. Thus, a rotational aspect of the cable swivel assembly 10 can be provided by the electrical contact assembly 26, which thereby prevents the cables 14, 15 from tangling, and allows continuous current supply and communication to the cleaner unit 12 from the power source.

Stated another way, in some embodiments, a non-rotating group of components (e.g., the other components of assembly 10 except second cable 15, shaft assembly 24, cleaner cable assembly 22, and first extension 26B) can be attached or secured relative to one another. Moreover, a rotating group of components (e.g., second cable 15, shaft assembly 24, cleaner cable assembly 22, and first extension 26B) can be attached/secured relative to each other and can rotate relative to the non-rotating group of components. Thus, when the cables 14 and/or 15 rotate or twist during operation of cleaner unit 12 (e.g., during travel of cleaner unit 12), the rotating components can rotate relative to the non-rotating components to prevent tangling of the cables 14, 15. As such, a point of rotation in cable swivel assembly 10 can occur at the electrical contact assembly 26. Tangling of the first and second cables 14, 15 is thereby prevented, while an electrical connection between the first and second cables 14, 15 is maintained (e.g., via the electrical contact assembly 26).

As noted, exemplary cable swivel assembly 10 includes a swivel body/housing 13. As shown in FIGS. 2-3 and 16-20, exemplary swivel housing 13 defines a hollow and substantially cylindrical body/housing 13, although the present disclosure is not limited thereto. Rather, swivel housing 13 may take a variety of forms, and may be fabricated from a variety of materials. In exemplary embodiments, housing 13 is substantially transparent, and is fabricated from injection molded polycarbonate.

In general, housing 13 is configured to be assembled together with other components of assembly 10 to create a waterproof enclosure for the continuous electrical contact between the first and second cables 14, 15. In general and as further discussed below, housing 13 houses at least some of the components that create an electrical connection between the first and second cables 14, 15.

Figure 18:
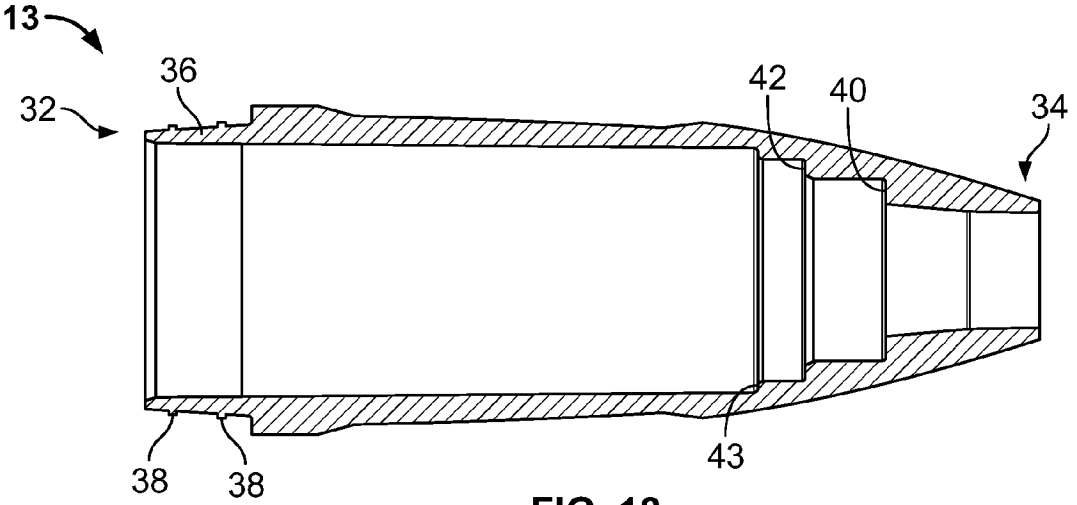
FIG. 18 is a cross-sectional view of the swivel housing of FIG. 17, and taken along the line 18-18 of FIG. 19.

In general, housing 13 extends from a first end 32 to a second end 34. In certain embodiments, housing 13 tapers from the first end 32 (the wider end) to the second end 34 (narrower end—FIG. 18). In certain embodiments, first end 32 of housing 13 includes a stepped surface 36 that extends inward or toward the center of housing 13 (FIG. 18). In general, stepped surface 36 extends radially around first end 32.

Figure 20:
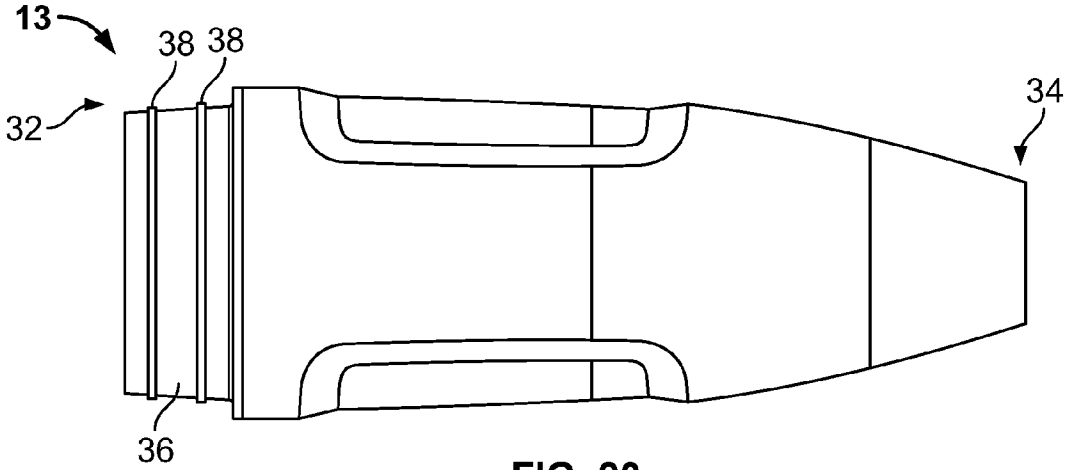
FIG. 20 is a side view of the swivel housing of FIG. 17.

In exemplary embodiments and as shown in FIGS. 18 and 20, the outer surface of the stepped surface 36 includes at least one rib member 38. Exemplary housing 13 includes two rib members 38.

In exemplary embodiments, rib members 38 extend away from the outer surface of housing 13, and extend axially/radially around the stepped surface 36 of the first end 32. It is noted that housing 13 can include one or more rib members 38 that extend in a variety of directions around and/or on first end 32 (e.g., extend longitudinally, and/or extend radially and longitudinally to create a cross-hatched or honey-combed pattern, etc.). Moreover, it is noted that the one or more rib members 38 can extend continuously or non-continuously around and/or on first end 32.

As shown in FIG. 18, the inner surface of the second end 34 of exemplary housing 13 includes a first shelf surface 40 and a second shelf surface 42. Each exemplary shelf surfaces 40, 42 each extend inward or toward the center of housing 13, and radially around the inner surface of second end 34. It is noted that housing 13 can also include a third shelf surface 43, or any suitable number of shelf surfaces.

Figure 9:
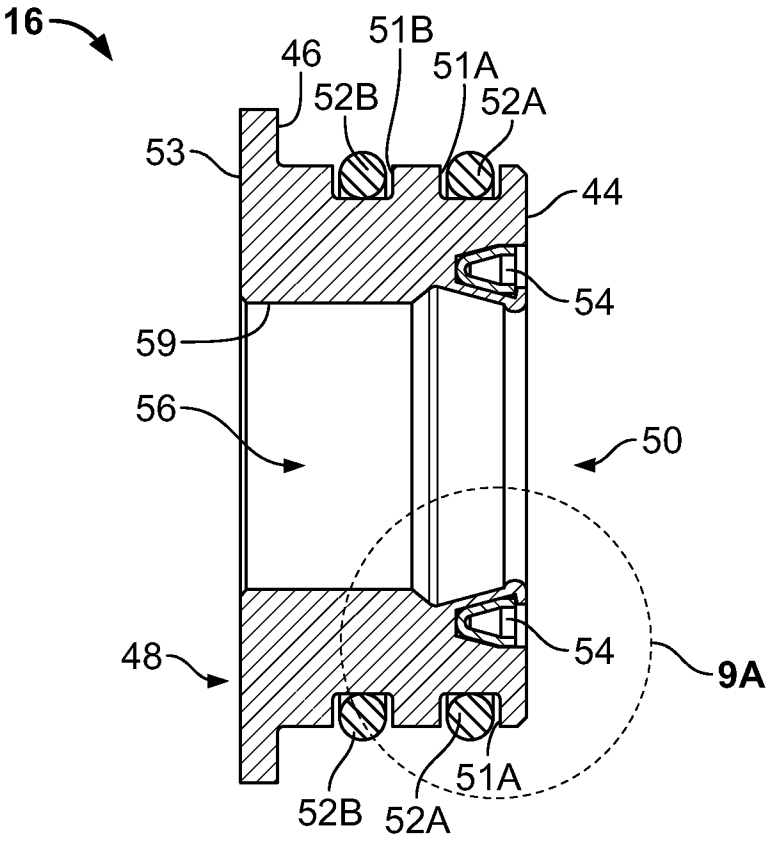
FIG. 9 is a cross-sectional side view of the seal member of FIG. 8.
Figure 8:
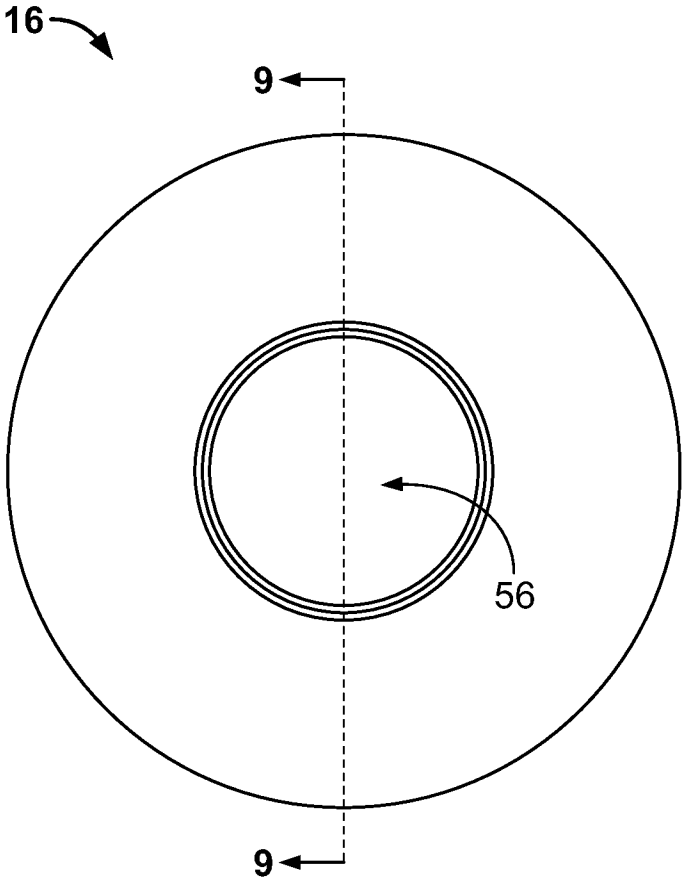
FIG. 8 is an end view an exemplary seal member for use with the cable swivel assembly of FIG. 2.

In exemplary embodiments and as discussed further below, first shelf surface 40 is configured and dimensioned to contact and/or engage a first contact surface 44 of seal member 16, and second shelf surface 42 is configured and dimensioned to contact and/or engage a second contact surface 46 of seal member 16 (FIGS. 3, 9 and 18).

As shown in FIGS. 3 and 8-9A, exemplary seal member 16 defines a hollow and substantially cylindrical seal member 16, although the present disclosure is not limited thereto. Rather, seal member 16 may take a variety of forms, and may be fabricated from a variety of materials. In exemplary embodiments, seal member 16 is fabricated from ultra-high molecular weight polyethylene or the like.

In general, seal member 16 is configured to be inserted into and mounted with respect to housing 13 so that the first contact surface 44 of seal member 16 contacts and/or engages the first shelf surface 40 of housing 13, and the second contact surface 46 of seal member 16 contacts and/or engages the second shelf surface 42 of housing 13 (FIGS. 3, 9 and 18).

In exemplary embodiments and as depicted in FIG. 9, seal member 16 extends from a first end 48 to a second end 50, and the outer surface of the second end 50 includes a first groove 51A that extends radially around second end 50. As shown in FIG. 9, exemplary first groove 51A is configured and dimensioned to at least partially house and/or secure a first gasketing material 52A (e.g., O-ring) or the like. The outer surface of the first end 48 (or second end 50) can include a second groove 51B that extends radially around first end 48 (or second end 50). Exemplary second groove 51B is configured and dimensioned to at least partially house and/or secure a second gasketing material 52B (e.g., O-ring).

Figure 9A:
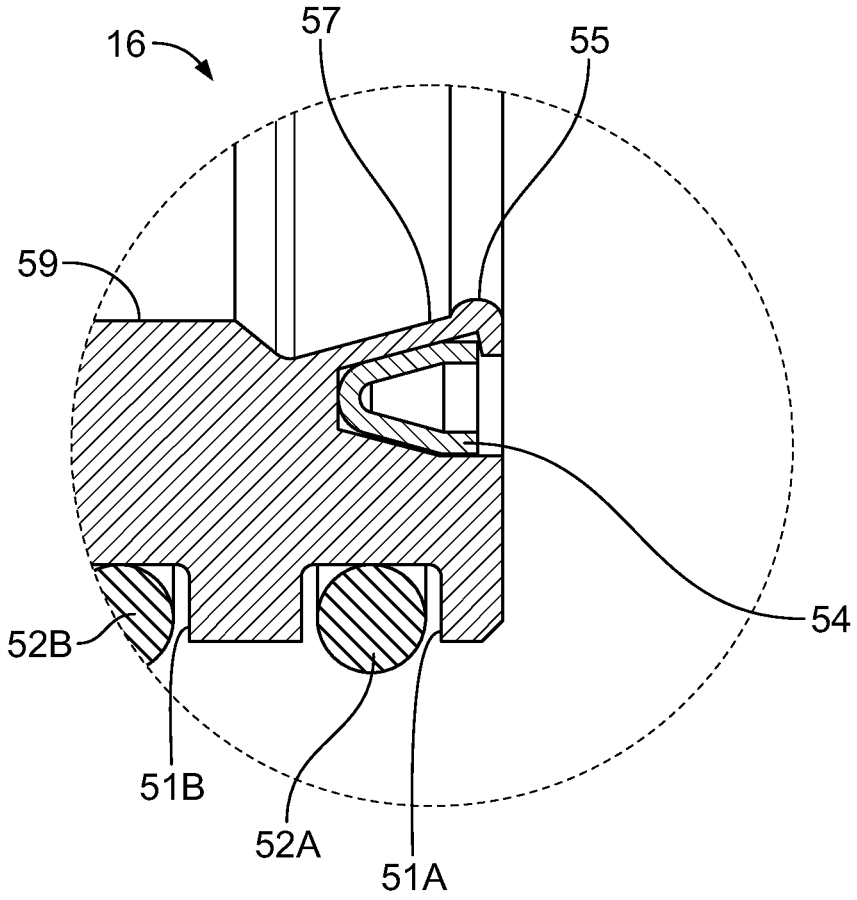
FIG. 9A is an exploded partial view of the seal member of FIG. 9.
Figure 10:
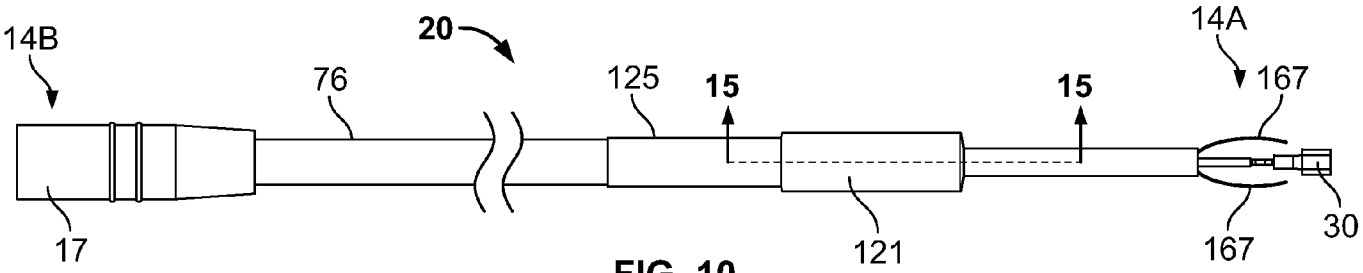
FIG. 10 is a partial side view of an exemplary power cable assembly for use with the cable swivel assembly of FIG. 2.
Figure 11:
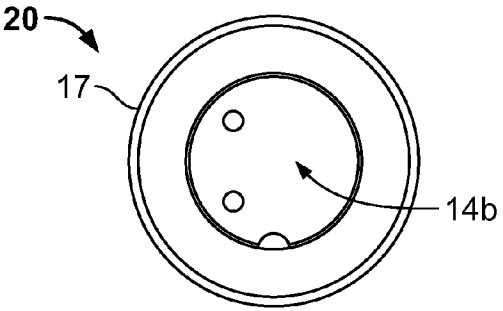
FIG. 11 is an end view of the power cable assembly of FIG. 10.

The second end 50 of exemplary seal member 16 also includes a spring-loaded sealing surface 54 that extends radially around the first contact surface 44 and proximal to the aperture 56 of seal member 16. As shown in FIGS. 9 and 9A, exemplary seal member 16 also includes a primary sealing surface 55, a secondary sealing surface 57 and a bearing surface 59. In certain embodiments, primary sealing surface 55, secondary sealing surface 57 and bearing surface 59 extend radially around the inner surface of seal member 16 proximal to aperture 56. In exemplary embodiments and as discussed further below, primary and secondary sealing surfaces 55, 57 are configured and dimensioned to provide two sealing/contact or engagement points/surfaces (e.g., interference fit) with a shaft member 58 positioned within aperture 56, while also allowing the shaft member 58 to rotate relative to seal member 16. Exemplary bearing surface 59 is configured and dimensioned to provide a substantially non-interference fit or engagement surface with shaft member 58 positioned within aperture 56, while also allowing the shaft member 58 to rotate relative to seal member 16, and also substantially preventing shaft member 58 from moving laterally within aperture 56 of seal member 16.

In general, seal member 16 is configured and dimensioned to be assembled together with other components of assembly 10 to create a waterproof enclosure for the continuous electrical contact between the first and second cables 14, 15. For example, once the seal member 16 is inserted into and mounted with respect to housing 13 (FIG. 3), the first and second gasketing materials 52A, 52B provide a fluid-tight seal between the seal member 16 and the housing 13. Moreover and as further discussed below, after the seal member 16 is mounted with respect to housing 13, and after the shaft assembly 24 is inserted into housing 13 (FIG. 3), the spring-loaded sealing surface 54 and the primary and secondary sealing surfaces 55, 57 of seal member 16 provides a fluid-tight seal between the seal member 16 and a shaft member 58 of shaft assembly 24, while also allowing the shaft assembly 24 and shaft member 58 (and second cable 15) to rotate relative to seal member 16 (and relative to housing 13).

As shown in FIGS. 3, 39 and 41-42, exemplary shaft member 58 defines a hollow and substantially cylindrical or tubular shaft member 58, although the present disclosure is not limited thereto. Rather, shaft member 58 may take a variety of forms, and may be fabricated from a variety of materials. In exemplary embodiments, shaft member 58 is fabricated from stainless steel or the like.

Figure 24:
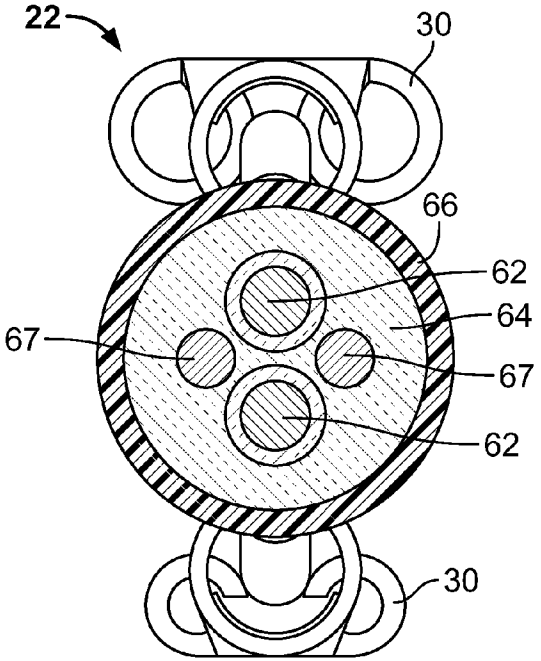
FIG. 24 is a cross-sectional view of the cable assembly of FIG. 23, and taken along the line 24-24 of FIG. 23.
Figure 25:
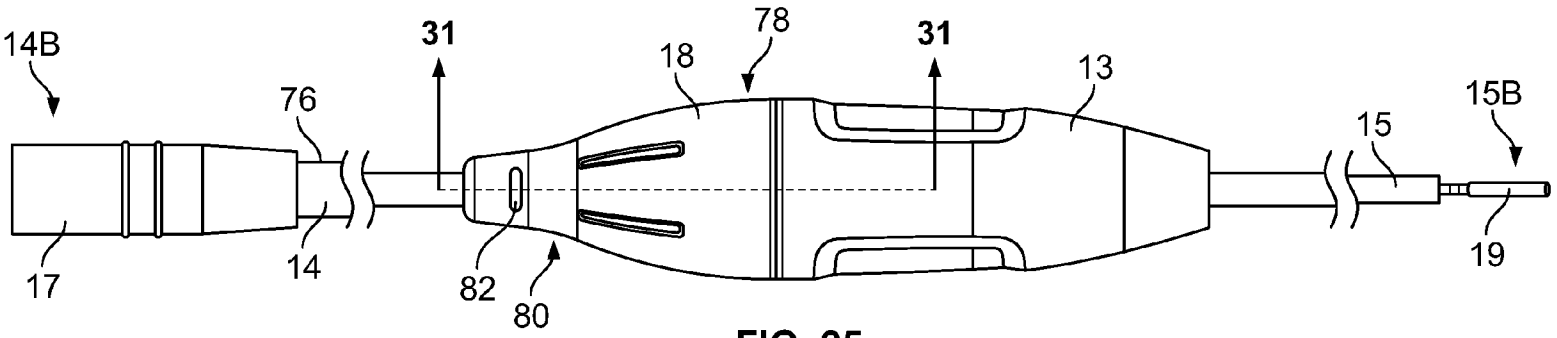
FIG. 25 is another side view of the cable swivel assembly of FIG. 2, after assembly.
Figure 27:
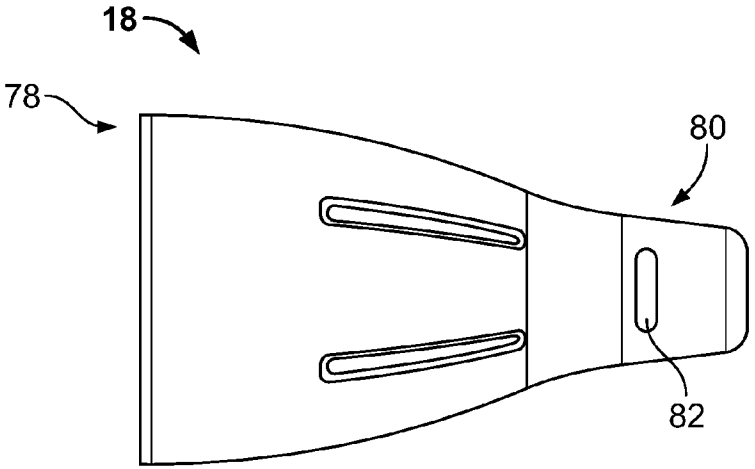
FIG. 27 is a side view of the overmold member of FIG. 26.
Figure 26:
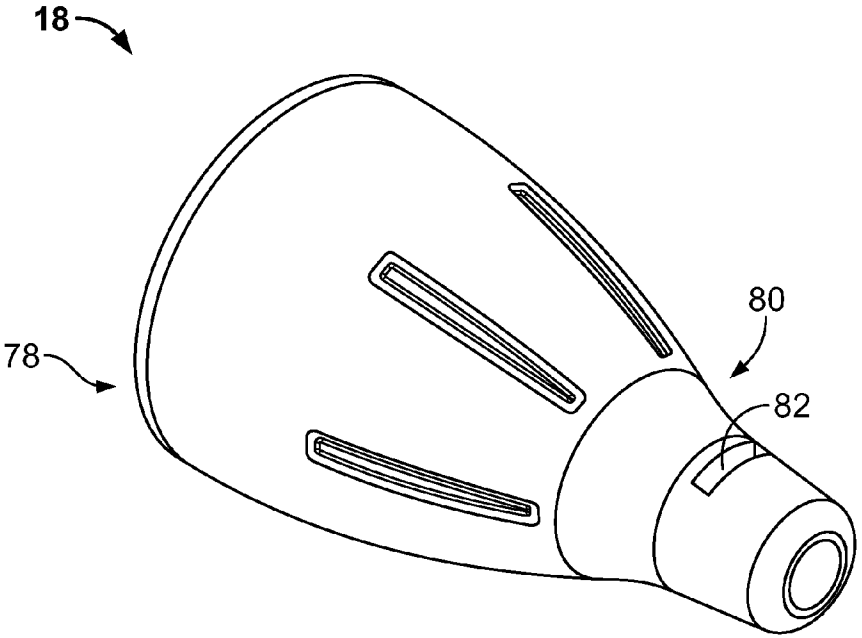
FIG. 26 is a side perspective view of an exemplary overmold member for use with the cable swivel assembly of FIG. 2.
Figure 28:
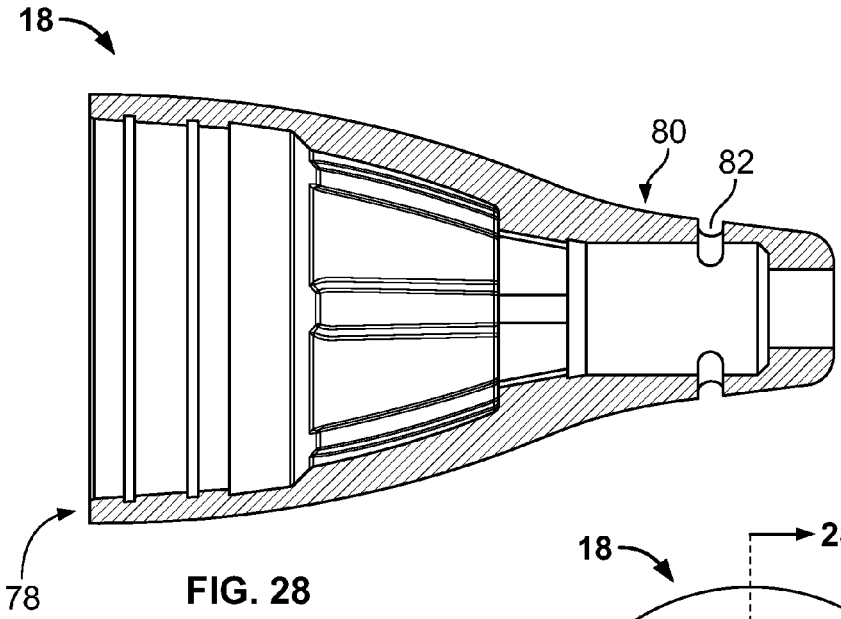
FIG. 28 is a cross-sectional view of the overmold member of FIG. 26, and taken along the line of 28-28 of FIG. 29.
Figure 29:
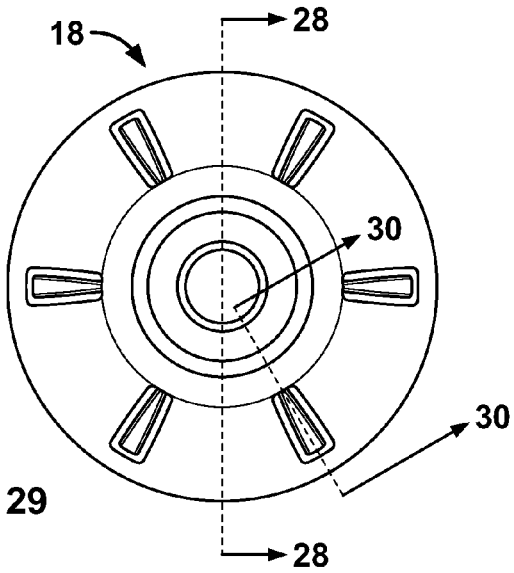
FIG. 29 is an end view of the overmold member of FIG. 26.
Figure 30:
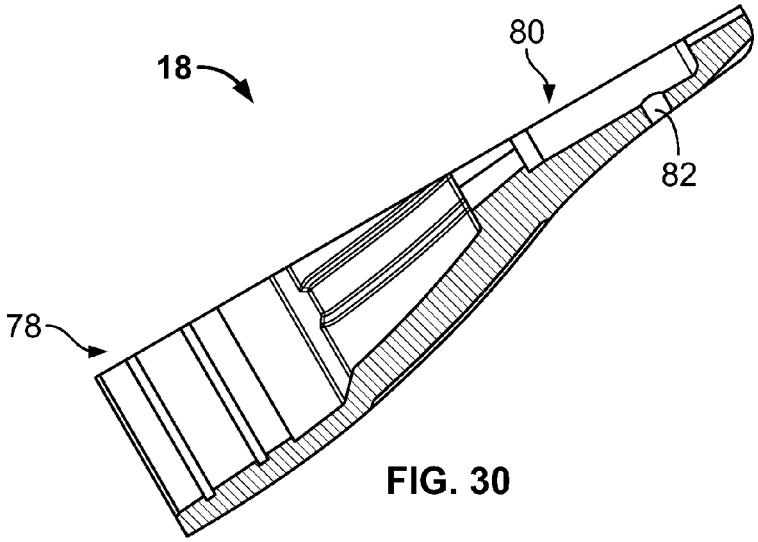
FIG. 30 is a partial cross-sectional view of the overmold member of FIG. 26, and taken along the line of 30-30 of FIG. 29.

In exemplary embodiments and in order to assemble/fabricate shaft assembly 24, at least a portion of the proximal end 15A of second cable 15 is positioned within the shaft member 58. As discussed further below and as shown in FIG. 24, it is noted that the exemplary portion of the second cable 15 that is positioned within shaft member 58 includes insulated wire conductors 62 (e.g., #16AWG 65/34 bare copper) inside an extruded core 64 (e.g., PVC core jacket), portions of which may be covered by a heat shrink material/tubing 66 (e.g., PVC heat shrink tubing). It is noted that exemplary heat shrink material/tubing 66 provides torsional rigidity to second cable 15. As shown in FIG. 24, exemplary cable 15 can also include strength members 67 (e.g., strands of aramid fiber).

Figure 42:
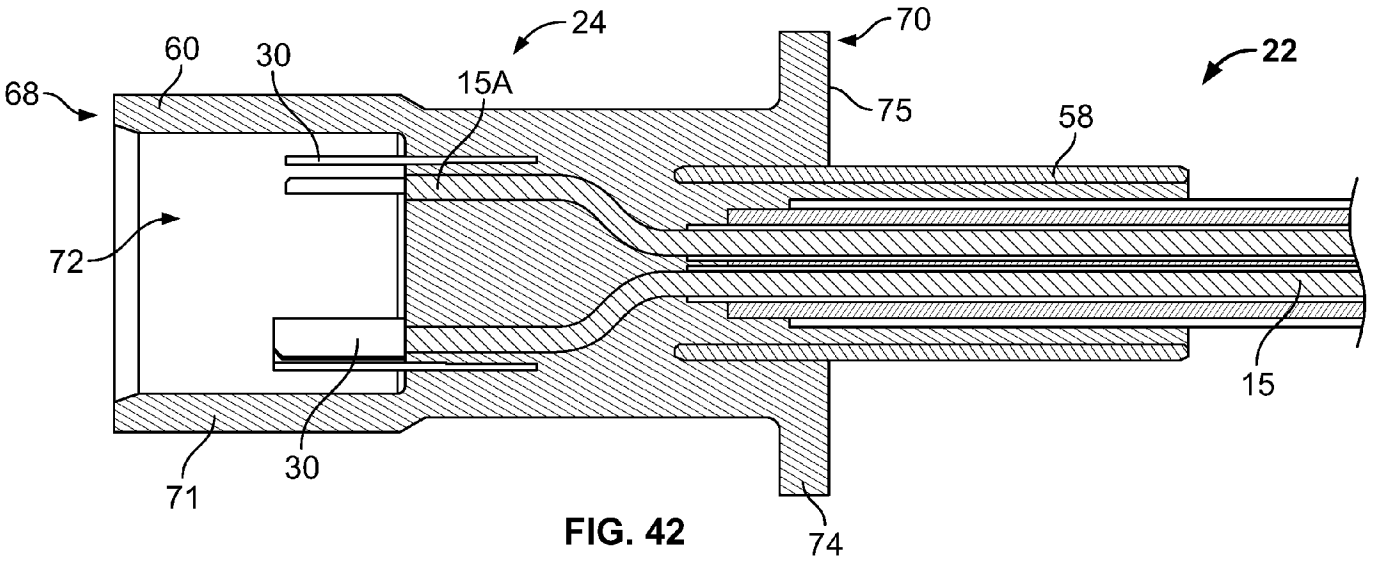
FIG. 42 is a partial cross-sectional view of the shaft assembly and the cable assembly of FIG. 41, and taken along the line 42-42 of FIG. 41.
Figure 43:
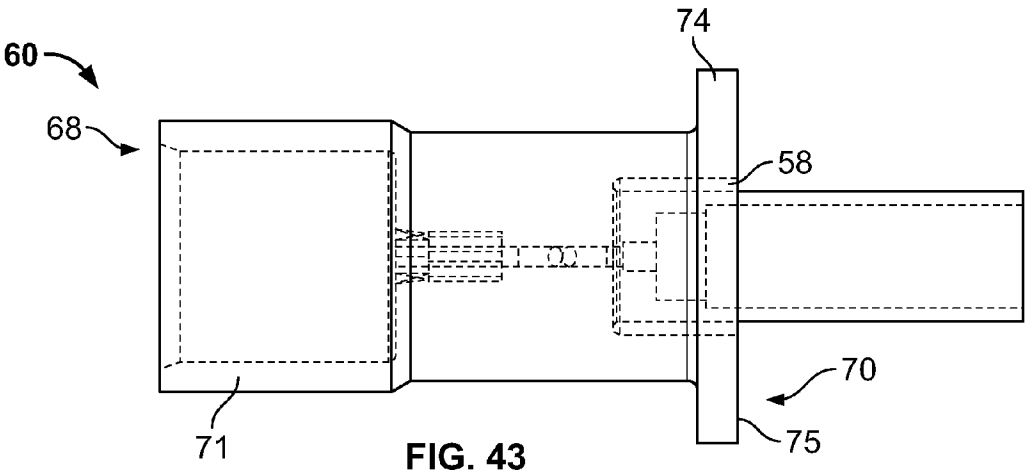
FIG. 43 is another partial side view of the shaft assembly of FIG. 39.

After a portion of the proximal end 15A of second cable 15 is positioned within the shaft member 58, the shaft assembly 24 is then assembled/fabricated by fabricating (e.g., overmolding) an outer member 60 around and over at least a portion of the shaft member 58 and around and over at least a portion of the proximal end 15A of second cable 15 (FIG. 42). In exemplary embodiments, after outer member 60 has been fabricated/overmolded around and over at least a portion of the shaft member 58 and at least a portion of the proximal end 15A of second cable 15, the outer member 60, cleaner cable assembly 22, second cable 15 and shaft member 58 are fixedly secured or mounted with respect to one another. Thus, when second cable 15 is turned/rotated by cleaner unit 12, the outer member 60, cleaner cable assembly 22, second cable 15 and shaft member 58 can rotate as a unit (e.g., via rotating extension 26B of electrical contact assembly 26) relative to the other components of assembly 10 (e.g., relative to housing 13, seal member 16, first cable 14, central body 26A and extension 26C of electrical contact assembly 26, etc.).

Moreover and as discussed further below, after outer member 60 has been fabricated/overmolded around and over at least a portion of the shaft member 58 and at least a portion of the proximal end 15A of second cable 15, it is noted that the terminals/connectors 30 of second cable 15 extend from a surface of outer member 60 (FIG. 42).

As shown in FIGS. 3 and 39-43, exemplary outer member 60 defines a partially hollow and substantially cylindrical or tubular outer member 60, although the present disclosure is not limited thereto. Rather, outer member 60 may take a variety of forms, and may be fabricated from a variety of materials. In exemplary embodiments, outer member 60 is fabricated or overmolded from a plastic or polymeric material or the like.

As shown in FIGS. 39-43, outer member 60 extends from a first end 68 to a second end 70. In exemplary embodiments, first end 68 includes a hollow portion 72, with hollow portion 72 configured and dimensioned to house the connectors 30 of second cable 15. As shown in FIG. 42, connectors 30 extend from a lower surface of hollow portion 72. As depicted in FIGS. 3 and 42, at least a portion of the outer wall 71 (e.g., radial wall 71) of hollow portion 72 is configured to mate and/or engage with the outer wall/section of rotating extension 26B of electrical contact assembly 26.

The second end 70 of exemplary outer member 60 includes a washer section 74 that protrudes radially around the second end 70. As shown in FIGS. 3, 9 and 42, the lower surface 75 of washer section 74 is configured and dimensioned to abut against the upper surface 53 of seal member 16 when the shaft assembly 24 is inserted into housing 13 containing mounted seal member 16. As such, lower surface 75 of washer section 70 is configured to rotate relative to upper surface 53 of seal member 16, after assembly 10 is fabricated/assembled and when second cable 15 is turned/rotated.

As noted above and as shown in FIGS. 21-24, cleaner cable assembly 22 associated with shaft assembly 24 includes second cable 15, connectors 19 (e.g., female pin connectors 19) and terminals/connectors 30 (e.g., female spade connectors 30).

Figure 21:
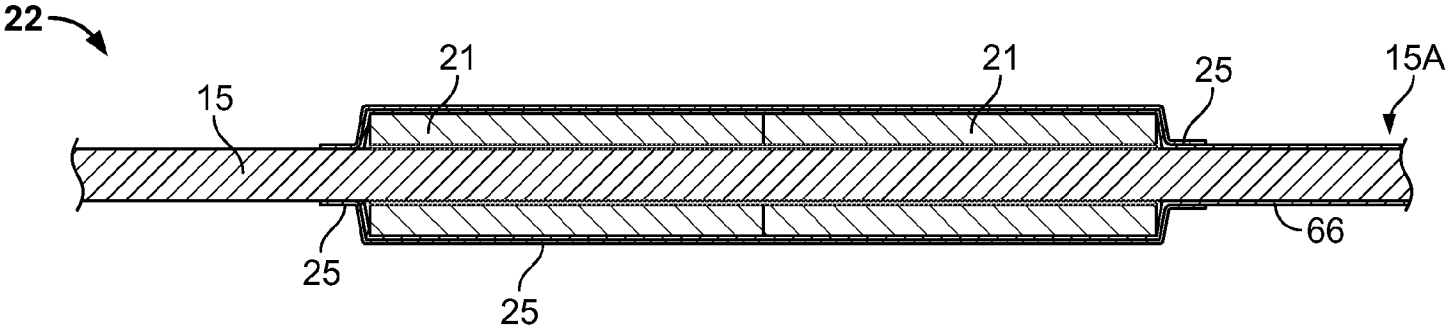
FIG. 21 is a partial cross-sectional view of an exemplary cable assembly for use with the cable swivel assembly of FIG. 2, and taken along the line 21-21 of FIG. 23.
Figure 22:
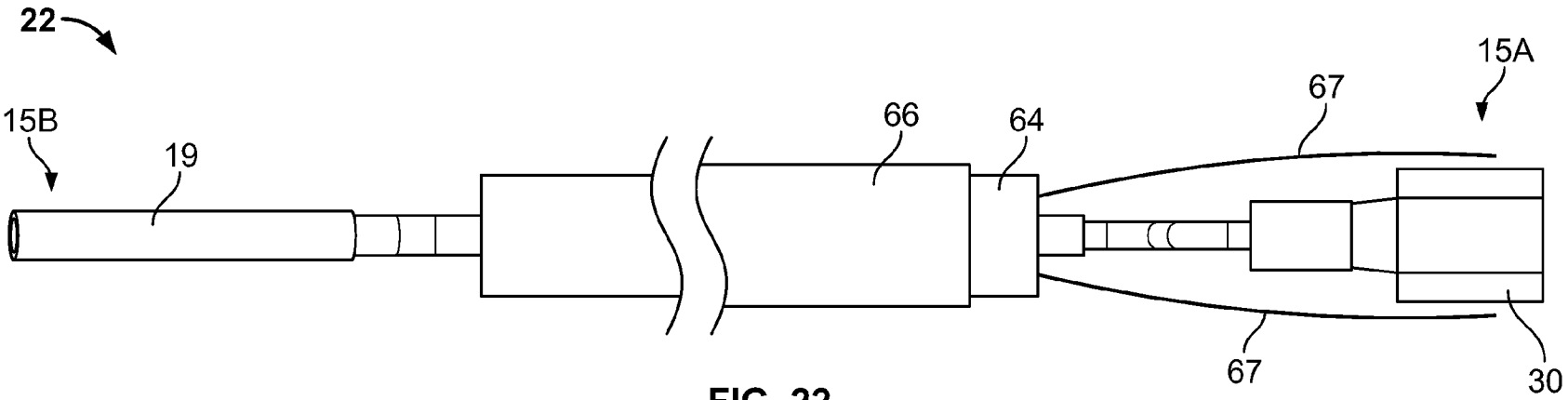
FIG. 22 is a partial side view of the cable assembly of FIG. 2.

In exemplary embodiments and as shown in FIGS. 2, 5, 21 and 23, cleaner cable assembly 22 also includes one or more suppression members 21 (e.g., ferrite electromagnetic interference ("EMI") suppression members or cable cores). Cleaner cable assembly 22 can also include at least one grommet member 23. In certain embodiments and as shown in FIG. 21, a secondary heat shrink material/tubing 25 (e.g., flexible polyolefin material) can cover each suppression member 21 and/or cover at least a portion of extruded core 64 and/or heat shrink material/tubing 66 of second cable 15.

With reference now to power cable assembly 20 and as depicted in FIGS. 2, 5 and 10-15, power cable assembly 20 includes first cable 14, plug 17, and terminals/connectors 30 (e.g., female spade connectors 30).

Figure 14:
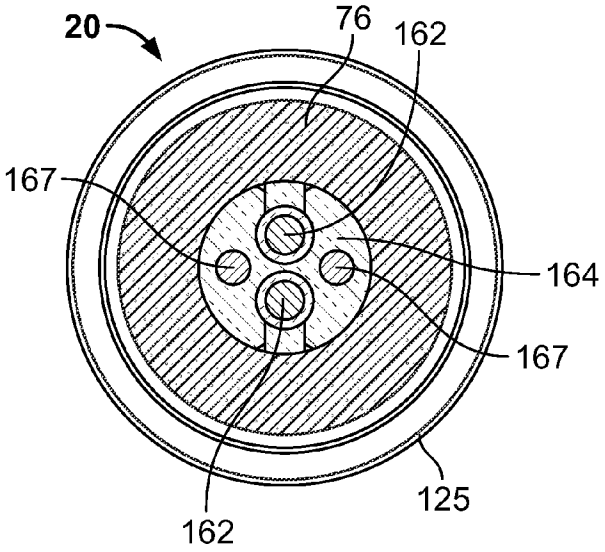
FIG. 14 is a cross-sectional view of the power cable assembly of FIG. 12, and taken along the line 14-14 of FIG. 12.
Figure 13:
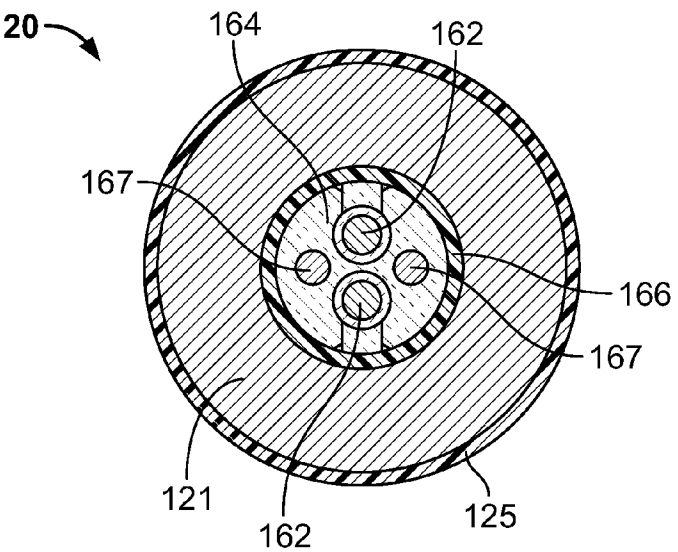
FIG. 13 is a cross-sectional view of the power cable assembly of FIG. 12, and taken along the line 13-13 of FIG. 12.

As shown in FIGS. 2, 5 and 10-15, it is noted that a proximal portion of exemplary first cable 14 includes insulated wire conductors 162 (e.g., #16AWG 65/34 bare copper) inside an extruded core 164 (e.g., PVC core jacket), portions of which may be covered by a heat shrink material/tubing 166 (e.g., PVC heat shrink tubing). It is noted that exemplary heat shrink material/tubing 166 provides torsional rigidity to first cable 14. As shown in FIGS. 13-14, exemplary first cable 14 can also include strength members 167 (e.g., strands of aramid fiber).

Power cable assembly 20 also includes one or more suppression members 121 (e.g., ferrite EMI suppression members or cable cores). In certain embodiments and as shown in FIGS. 10-15, a secondary heat shrink material/tubing 125 (e.g., flexible polyolefin material) can cover each suppression member 121 and/or cover at least a portion of extruded core 164 and/or heat shrink material/tubing 166 of first cable 14.

Figure 15:
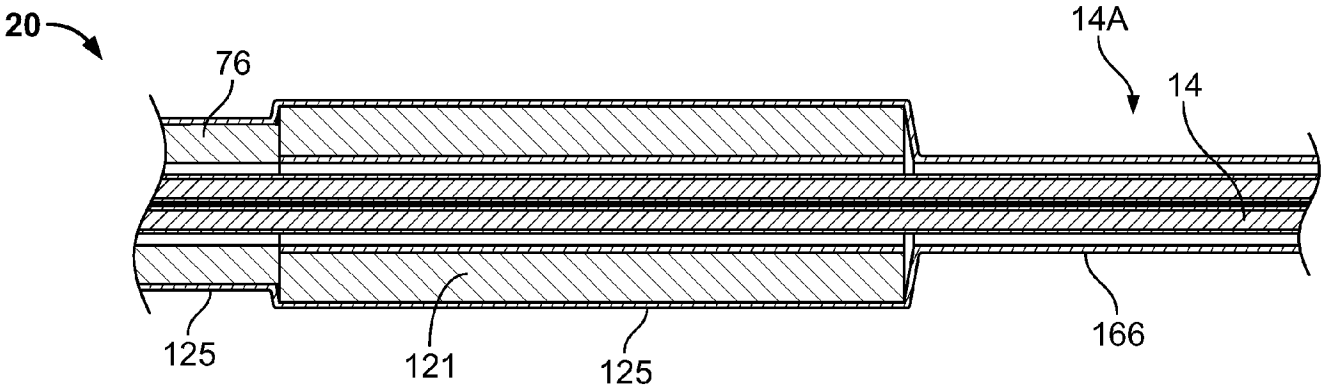
FIG. 15 is a partial cross-sectional view of the power cable assembly of FIG. 10, and taken along the line 15-15 of FIG. 10.
Figure 17:
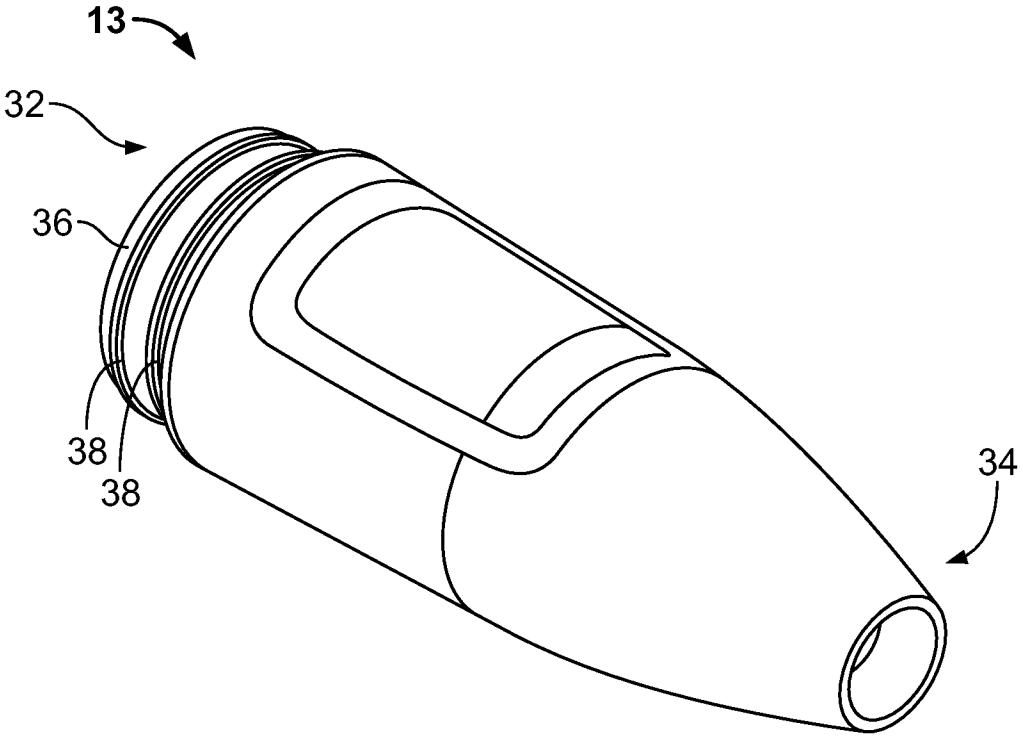
FIG. 17 is a side perspective view of the swivel housing of FIG. 2.
Figure 16:
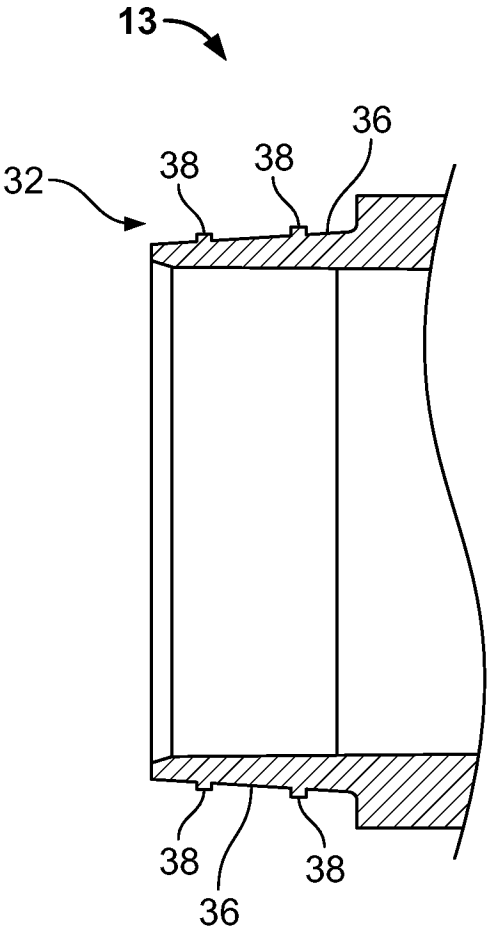
FIG. 16 is a partial cross-sectional view of an exemplary swivel housing for use with the cable swivel assembly of FIG. 2, and taken along the line 18-18 of FIG. 19.
Figure 19:
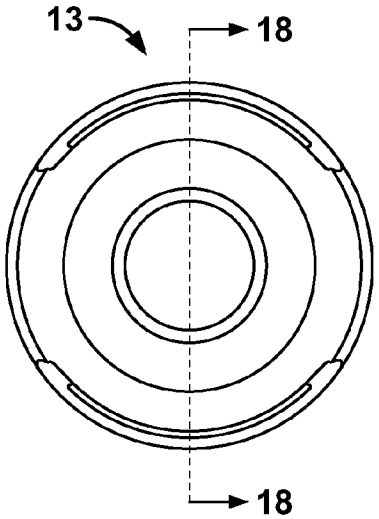
FIG. 19 is an end view of the swivel housing of FIG. 17.

In exemplary embodiments and as shown in FIGS. 12 and 14, at least a portion of first cable 14 extending from suppression member 121 and towards the distal end 14B includes insulated wire conductors 162 inside the extruded core 164, portions of which may be covered by a jacket material 76 (e.g., a floating or buoyant foam material 76 or the like). As shown in FIGS. 12, 14 and 15, portions of jacket material 76 can be covered by secondary heat shrink material/tubing 125.

Prior to final assembly/fabrication of electric cable swivel assembly 10, a support member 28 is mounted, fabricated or overmolded with respect to at least a portion of power cable assembly 20 (FIGS. 3 and 31).

In exemplary embodiments, the support member 28 and mounted power cable assembly 20 is assembled/fabricated by fabricating (e.g., overmolding) the support member 28 around and over at least a portion of the proximal end 14A of first cable 14. In certain embodiments, after support member 28 has been fabricated/overmolded around and over at least a portion of the proximal end 14A of first cable 14, the support member 28, power cable assembly 20, and first cable 14 are fixedly secured or mounted with respect to one another.

As discussed further below, after support member 28 has been fabricated/overmolded around and over at least a portion of the proximal end 14A of first cable 14, it is noted that the terminals/connectors 30 of first cable 14 extend from a surface of support member 28 (FIG. 31).

As shown in FIGS. 31-38, exemplary support member 28 defines a partially hollow and partially cylindrical support member 28, although the present disclosure is not limited thereto. Rather, support member 28 may take a variety of forms, and may be fabricated from a variety of materials. In exemplary embodiments, support member 28 is fabricated or overmolded from a plastic or polymeric material or the like.

As shown in FIGS. 31-38, support member 28 extends from a first end 27 to a second end 29. In exemplary embodiments, second end 29 includes a hollow portion 31, with hollow portion 31 configured and dimensioned to house the connectors 30 of first cable 14. In certain embodiments, connectors 30 extend from a lower surface of hollow portion 31 (FIG. 31). As depicted in FIGS. 3 and 31, at least a portion of the outer wall 33 (e.g., radial wall 33) of hollow portion 31 is configured to mate and/or engage with the outer wall/section of extension 26C of electrical contact assembly 26.

Figure 36:
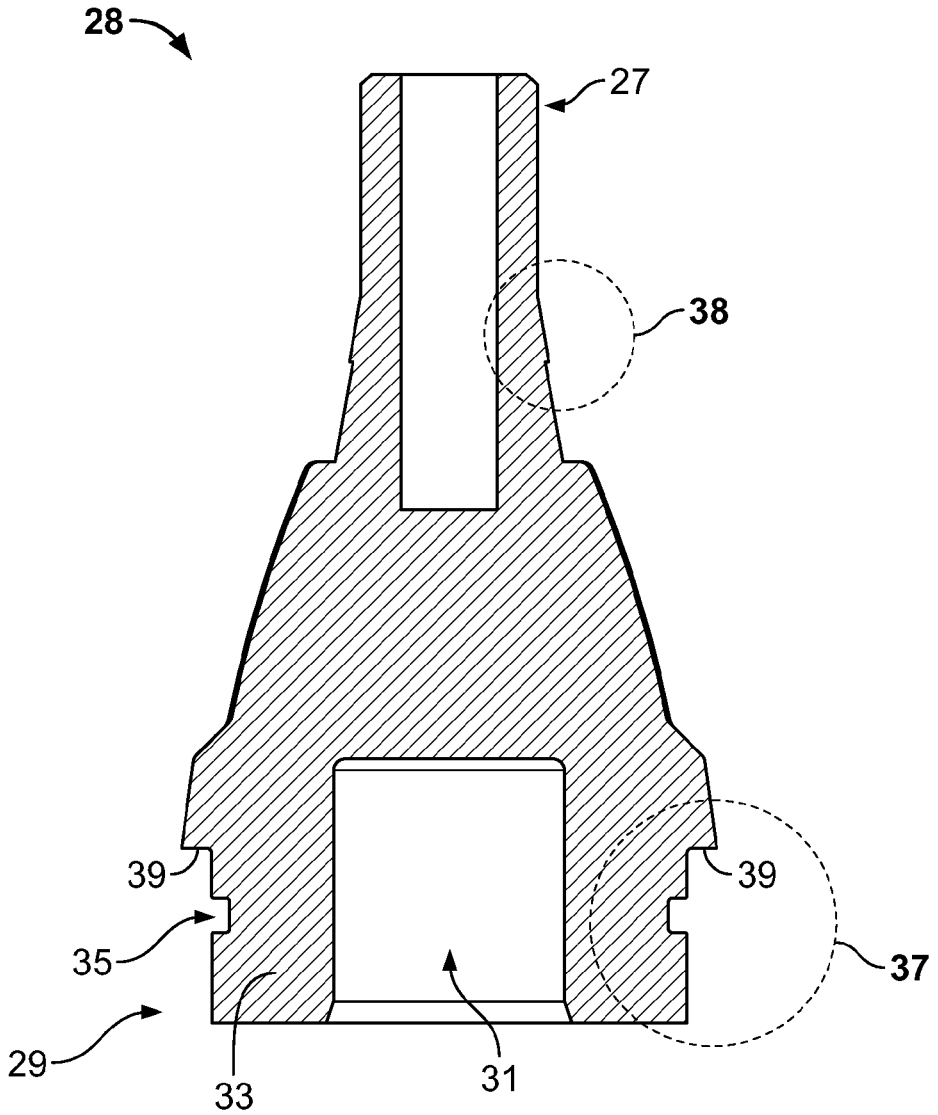
FIG. 36 is a cross-sectional view of the receiver member of FIG. 32, and taken along the line 36-36 of FIG. 33.
Figure 37:
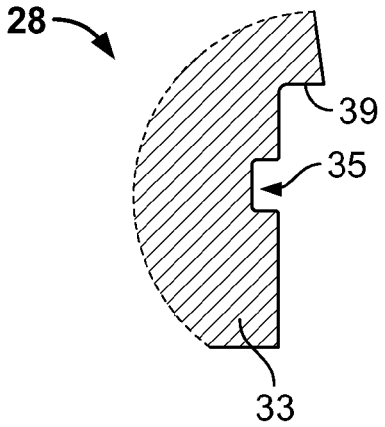
FIGS. 37-38 are partial exploded views of the receiver member of FIG. 36.
Figure 38:
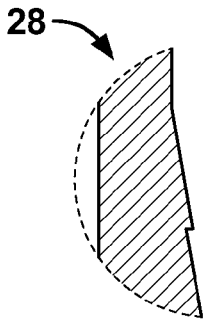
Figure 39:
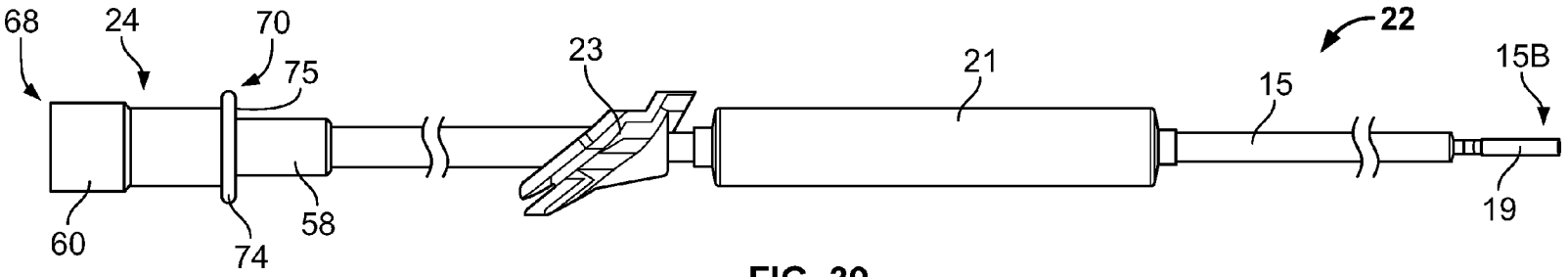
FIG. 39 is a partial side view of an exemplary shaft assembly for use with the cable swivel assembly of FIG. 2, along with the cable assembly of FIG. 23.
Figure 40:
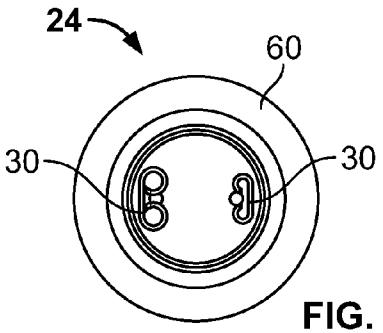
FIG. 40 is an end view of the shaft assembly of FIG. 39.
Figure 41:
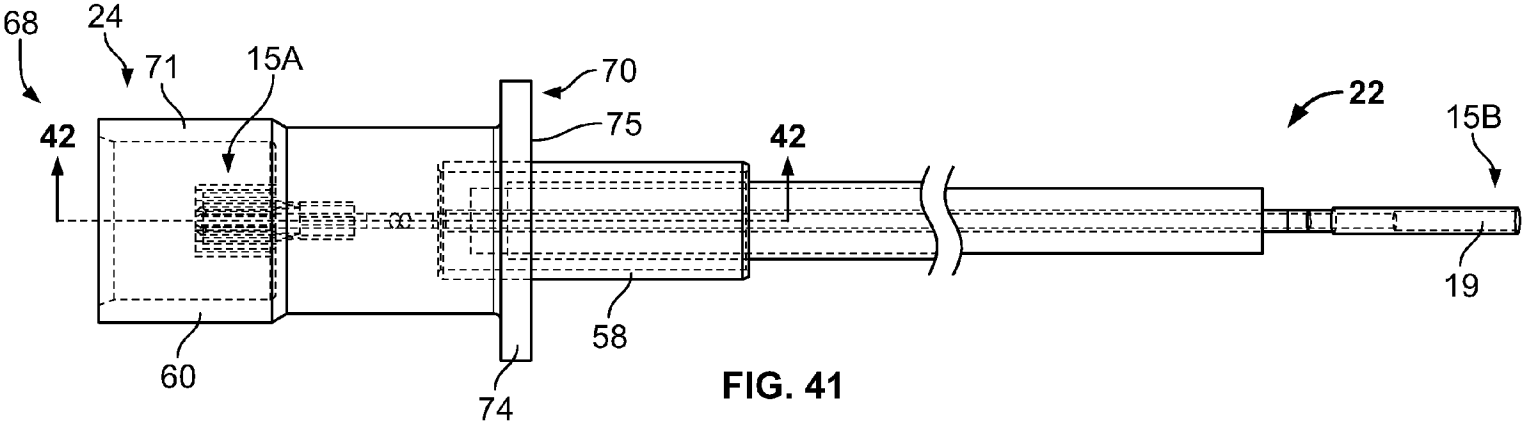
FIG. 41 is another partial side view of the shaft assembly and the cable assembly of FIG. 39.

In exemplary embodiments and as shown in FIGS. 31 and 36, the outer wall 33 of the second end 29 includes a groove 35 that extends radially around second end 29. As shown in FIGS. 3 and 31, exemplary groove 35 is configured and dimensioned to at least partially house and/or secure a gasketing material 37 (e.g., O-ring) or the like. The second end 29 of exemplary support member 28 also includes an abutment surface 39 that extends radially around the second end 29 and is configured and dimensioned to abut against the first end 32 of housing 13 (FIGS. 3 and 31).

In general, support member 28 is configured and dimensioned to be assembled together with other components of assembly 10 to create a waterproof enclosure for the continuous electrical contact between the first and second cables 14, 15. For example, once the second end 29 of support member 28 is inserted into and mounted with respect to housing 13 (FIGS. 3 and 31), the gasketing material 37 provides a fluid-tight seal between the support member 28 and the housing 13.

During assembly of electric cable swivel assembly 10, first the seal member 16 can be inserted into and mounted with respect to housing 13. For example, seal member 16 can be inserted into and mounted with respect to housing 13 so that the first contact surface 44 of seal member 16 contacts and/or engages the first shelf surface 40 of housing 13, and the second contact surface 46 of seal member 16 contacts and/or engages the second shelf surface 42 of housing 13 (FIGS. 3, 9 and 18). As noted, once the seal member 16 is inserted into and mounted with respect to housing 13 (FIG. 3), the first and second gasketing materials 52A, 52B provide a fluid-tight seal between the seal member 16 and the housing 13.

Next, the shaft assembly 24 and associated second cable 15 is inserted into housing 13 containing the mounted seal member 16, until the lower surface 75 of washer section 74 of the outer member 60 of the shaft assembly 24 abuts against the upper surface 53 of seal member 16. As noted, lower surface 75 of washer section 70 is configured to rotate relative to upper surface 53 of seal member 16, after assembly 10 is fabricated/assembled and when second cable 15 is turned/rotated. Moreover, after the seal member 16 is mounted with respect to housing 13, and after the shaft assembly 24 is inserted into housing 13 (FIG. 3), the spring-loaded sealing surface 54 of seal member 16 provides a fluid-tight seal between the seal member 16 and the shaft member 58 of shaft assembly 24, while also allowing the shaft assembly 24 and shaft member 58 (and second cable 15) to rotate relative to seal member 16 (and relative to housing 13).

Next, the first end 68 of outer member 60 of shaft assembly 24 is mated/engaged with the rotating extension 26B of electrical contact assembly 26. As noted, at least a portion of the outer wall 71 of hollow portion 72 of outer member 60 is configured to mate and/or engage with the outer wall/section of rotating extension 26B of electrical contact assembly 26. Moreover, connectors 30 of cable assembly 22 are configured to mate with connectors/plugs 41 of rotating extension 26B of electrical contact assembly 26.

Next, the support member 28 and associated first cable 14 is inserted at least partially into housing 13 until the abutment surface 39 of the support member 28 abuts against the first end 32 of housing 13 (FIGS. 3 and 31). As noted, once the second end 29 of support member 28 is inserted into and mounted with respect to housing 13 (FIGS. 3 and 31), the gasketing material 37 can provide a fluid-tight seal between the support member 28 and the housing 13. Moreover, at least a portion of the outer wall 33 of hollow portion 31 of support member 28 is configured to mate and/or engage with the outer wall/section of extension 26C of electrical contact assembly 26, and connectors 30 of cable assembly 20 are configured to mate with connectors/plugs 41 of extension 26C of electrical contact assembly 26 to thereby provide an electrical connection between the first and second cables 14 and 15 (via electrical contact assembly 26).

Next, this sub-assembly is positioned in a tool (e.g., overmolding tool) that is configured and adapted to apply the overmold member 18 to electric cable swivel assembly 10 (FIGS. 2, 3, 5-7 and 25-31). In exemplary embodiments, during the overmolding process, the tool (e.g., overmolding tool) includes one or more protruding members or bosses that press against, stabilize and/or substantially immobilize the support member 28 during fabrication of the overmold member 18 on assembly 10. As shown in FIGS. 3, 25-28, 30 and 31, the one or more bosses/protruding members of the tool thereby provide or fabricate one or more recesses 82 of overmold member 18 after fabrication of overmold member 18.

In exemplary embodiments and as depicted in FIGS. 2, 3, 5-7 and 25-31, the overmold member 18 is a flexible plastic member/material that is applied to assembly 10 during the final stages of fabrication. In certain embodiments, the overmold member 18 bonds (e.g., chemically bonds) to the support member 28, to the housing 13 and/or to power cable assembly 20 to hermetically secure the assembly 10 as a singular working unit or assembly 10. In exemplary embodiments, it is noted that the one or more rib members 38 of housing 13 provide mating/engagement surfaces with overmold member 18, and/or the abutment surface 39 of support member 28 provides a mating/engagement surface with overmold member 18.

In general, overmold member 18 extends from a first end 78 to a second end 80. In certain embodiments, overmold member 18 tapers from the first end 78 (the wider end) to the second end 80 (narrower end—FIG. 28). As shown in FIGS. 25-30, exemplary overmold member 18 defines a hollow and substantially cylindrical overmold member 18, although the present disclosure is not limited thereto. Rather, overmold member 18 may take a variety of forms, and may be fabricated from a variety of materials. In exemplary embodiments, overmold member 18 is fabricated or overmolded from a plastic or polymeric material or the like.

As noted above, after electric cable swivel assembly 10 is fabricated and assembled together, assembly 10 thereafter allows at least some of the components of the second cable 15, shaft assembly 24 and cleaner cable assembly 22, along with first extension 26B, to rotate (e.g., axially rotate) relative to at least some of the other components of cable swivel assembly 10 (e.g., the other components of assembly 10 except second cable 15, shaft assembly 24, cleaner cable assembly 22, and first extension 26B). The exemplary rotating components are configured to axially rotate while maintaining an electrical connection between the first and second cables 14, 15, and this rotational aspect of the cable swivel assembly 10 thereby advantageously prevents the cables 14, 15 from tangling, and allows continuous current supply and communication to the cleaner unit 12 from the power source. In other words, when the cables 14 and/or 15 rotate or twist during operation of cleaner unit 12 (e.g., during travel of cleaner unit 12), the rotating components can rotate relative to the non-rotating components to advantageously prevent tangling of the cables 14, 15. In short, tangling of the first and second cables 14, 15 is thereby prevented by the improved electric cable swivel assembly 10, while an electrical connection between the first and second cables 14, 15 is maintained.

Whereas the disclosure has been described principally in connection with electric cable swivel assemblies for use in for use in cleaning surfaces of a swimming pool or the like, such description has been utilized only for purposes of disclosure and is not intended as limiting the disclosure. To the contrary, it is to be recognized that the disclosed electric cable swivel assemblies are capable of use with other cleaner units or the like for other cleaning purposes (e.g., for use in cleaning surfaces of a spa, tub, tank, fluid system, etc.).

Although the systems and methods of the present disclosure have been described with reference to exemplary embodiments thereof, the present disclosure is not limited to such exemplary embodiments and/or implementations. Rather, the systems and methods of the present disclosure are susceptible to many implementations and applications, as will be readily apparent to persons skilled in the art from the disclosure hereof. The present disclosure expressly encompasses such modifications, enhancements and/or variations of the disclosed embodiments. Since many changes could be made in the above construction and many widely different embodiments of this disclosure could be made without departing from the scope thereof, it is intended that all matter contained in the drawings and specification shall be interpreted as illustrative and not in a limiting sense. Additional modifications, changes, and substitutions are intended in the foregoing disclosure. Accordingly, it is appropriate that the appended claims be construed broadly and in a manner consistent with the scope of the disclosure.

What is claimed is:

1. An electric cable swivel assembly comprising:

a housing that extends from a first end to a second end;

a seal member configured to mount with respect to the second end of the housing, the seal member extending from a first end to a second end and having an aperture that extends from the first end to the second end;

a shaft assembly having an outer member extending from a first end to a second end and having the second end of the outer member mounted with respect to a shaft member and to a first cable assembly associated with a first cable, the shaft member configured to be at least partially housed within the aperture of the seal member and rotatable relative to the seal member and to the housing when the seal member is mounted with respect to the housing;

an electrical contact assembly extending from a first end to a second end, the second end of the electrical contact assembly mounted with respect to the first end of the outer member;

a support member extending from a first end to a second end and having: (i) the first end of the support member mounted with respect to a second cable assembly associated with a second cable, and (ii) the second end mounted with respect to the first end of the electrical contact assembly; and an overmold member positioned over at least a portion of the housing and the support member, the overmold member configured to hermetically secure the housing and the support member;

wherein the electrical contact assembly connects the first cable and the second cable and provides a continuous electrical contact between the first cable and the second cable while the first cable rotates axially relative to the second cable.

2. The electric cable swivel assembly of claim 1, wherein the first cable extends from a first end to a second end, the first end of the first cable mounted with respect to the outer member and the second end of the first cable mounted with respect to a pool cleaner unit; and wherein the second cable extends from a first end to a second end, the first end of the second cable mounted with respect to the support member and the second end of the second cable mounted with respect to a power source.

3. The electric cable swivel assembly of claim 1, wherein the first end of the housing includes at least one rib member that extends from the first end of the housing, the at least one rib member configured to engage the overmold member to facilitate the hermetic securement of the housing.

4. The electric cable swivel assembly of claim 1, wherein the second end of the housing includes a first shelf surface and a second shelf surface;

wherein the seal member includes a first contact surface and a second contact surface; and wherein when the seal member is mounted with respect to the housing, the first shelf surface of the housing engages the first contact surface of the seal member, and the second shelf surface of the housing engages the second contact surface of the seal member.

5. The electric cable swivel assembly of claim 1, wherein an outer surface of the seal member includes a first groove that houses a first gasketing material, and a second groove that houses a second gasketing material; and wherein when the seal member is mounted with respect to the housing, the first and second gasketing materials form a fluid-tight seal between the seal member and the housing.

6. The electric cable swivel assembly of claim 1, wherein the seal member includes a spring-loaded sealing surface that extends around and proximal to the aperture of the seal member; and wherein when the shaft member is housed within the aperture of the seal member, the spring-loaded sealing surface of the seal member provides a fluid-tight seal between the seal member and the shaft member while allowing the shaft member to rotate relative to the seal member.

7. The electric cable swivel assembly of claim 1, wherein the shaft member is substantially tubular;

wherein a portion of the first cable is positioned within the shaft member; and wherein the outer member of the shaft assembly is an internal overmold member that is positioned around at least a portion of the shaft member and the first cable to secure the outer member, shaft member and first cable relative to one another.

8. The electric cable swivel assembly of claim 1, wherein the second end of the outer member includes a protruding section that abuts an abutment surface of the seal member when the shaft member is housed within the aperture of the seal member.

9. The electric cable swivel assembly of claim 1, wherein the first and second cable assemblies include at least one electromagnetic interference suppression member.

10. The electric cable swivel assembly of claim 1, wherein the support member is an internal overmold member that is positioned around at least a portion of the second cable to secure the support member and the second cable relative to one another.

11. The electric cable swivel assembly of claim 1, wherein an outer surface of the second end of the support member includes a groove that houses a gasketing material;

wherein the second end of the support member includes an abutment surface;

wherein when the housing and the support member are hermetically secured, the abutment surface abuts against the first end of the housing, and the gasketing material provides a seal between the support member and the housing.

12. A method for fabricating an electric cable swivel assembly for a swimming pool cleaner power cable comprising:

providing a housing that extends from a first end to a second end;

providing a seal member, the seal member extending from a first end to a second end and having an aperture that extends from the first end to the second end;

mounting the seal member with respect to the second end of the housing;

providing a shaft assembly having an outer member extending from a first end to a second end;

mounting the second end of the outer member with respect to a shaft member and to a first cable assembly associated with a first cable;

housing at least a portion of the shaft member within the aperture of the seal member so that the shaft member is rotatable relative to the seal member and to the housing after the seal member is mounted with respect to the housing;

providing an electrical contact assembly extending from a first end to a second end;

mounting the second end of e electrical contact assembly with respect to the first end of the outer member;

providing a support member extending from a first end to a second end;

mounting the first end of the support member with respect to a second cable assembly associated with a second cable;

mounting the second end of the support member with respect to the first end of the electrical contact assembly; and overmolding an overmold member over at least a portion of the housing and the support member to hermetically secure the housing and the support member;

wherein the electrical contact assembly connects the first cable and the second cable and provides a continuous electrical contact between the first cable and the second cable while the first cable rotates axially relative to the second cable.

13. The method of claim 12, wherein the first cable extends from a first end to a second end, the first end of the first cable mounted with respect to the outer member and the second end of the first cable mounted with respect to a pool cleaner unit; and wherein the second cable extends from a first end to a second end, the first end of the second cable mounted with respect to the support member and the second end of the second cable mounted with respect to a power source.

14. The method of claim 12, wherein the first end of the housing includes at least one rib member that extends from the first end of the housing, the at least one rib member configured to engage the over old member to facilitate the hermetic securement of the housing.

15. The method of claim 12, wherein the second end of the housing includes a first shelf surface and a second shelf surface;

wherein the seal member includes a first contact surface and a second contact surface; and wherein when the seal member is mounted with respect to the housing, the first shelf surface of the housing engages the first contact surface of the seal member, and the second shelf surface of the housing engages the second contact surface of the seal member.

16. The method of claim 12, wherein an outer surface of the seal member includes a first groove that houses a first gasketing material, and a second groove that houses a second gasketingmaterial; and wherein when the seal member is mounted with respect to the housing, the first and second gasketing materials form a fluid-tight seal between the seal member and the housing.

17. The method of claim 12, wherein the seal member includes a spring-loaded sealing surface that extends around and proximal to the aperture of the seal member; and wherein when the shaft member is housed within the aperture of the seal member, the spring-loaded sealing surface of the seal member provides a fluid-tight seal between the seal member and the shaft member while allowing the shaft member to rotate relative to the seal member.

18. The method of claim 12, wherein the shaft member is substantially tubular;

wherein a portion of the first cable is positioned within the shaft member; and wherein the outer member is an overmold member that is positioned around at least a portion of the shaft member and the first cable to secure the overmold member, shaft member and first cable relative to one another.

19. The method of claim 12, wherein the second end of the outer member includes a protruding section that abuts an abutment surface of the seal member when the shaft member is housed within the aperture of the seal member.

20. The method of claim 12, wherein the first and second cable assemblies include at least one electromagnetic interference suppression member.

21. The method of claim 12, wherein the support member is an internal overmold member that is positioned around at least a portion of the second cable to secure the support member and the second cable relative to one another.

22. The method of claim 12, wherein an outer surface of the second end of the support member includes a groove that houses a gasketing material;

wherein the second end of the support member includes an abutment surface;

wherein when the housing and the support member are hermetically secured, the abutment surface abuts against the first end of the housing, and the gasketing material provides a seal between the support member and the housing.

23. An electric cable swivel assembly fabricated according to the steps comprising:

providing a housing that extends from a first end to a second end;

providing a seal member, the seal member extending from a first end to a second end and having an aperture that extends from the first end to the second end;

mounting the seal member with respect to the second end of the housing;

providing a shaft assembly having an outer member extending from a first end to a second end;

mounting the second end of the outer member with respect to a shaft member and to a first cable assembly associated with a first cable;

housing at least a portion of the shaft member within the aperture of the seal member so that the shaft member is rotatable relative to the seal member and to the housing after the seal member is mounted with respect to the housing;

providing an electrical contact assembly extending from a first end to a second end;

mounting the second end of the electrical contact assembly with respect to the first end of the outer member;

providing a support member extending from a first end to a second end;

mounting the first end of the support member with respect to a second cable assembly associated with a second cable;

mounting the second end of the support member with respect to the first end of the electrical contact assembly; and overmolding an overmold member over at least a portion of the housing and the support member to hermetically secure the housing and the support member;

wherein the electrical contact assembly connects the first cable and the second cable and provides a continuous electrical contact between the first cable and the second cable while the first cable rotates axially relative to the second cable.

* * * * *